US007213552B1

(12) United States Patent
Griffiths

(10) Patent No.: US 7,213,552 B1
(45) Date of Patent: May 8, 2007

(54) VARIABLE GEOMETRY CAMSHAFT

(76) Inventor: Gary L. Griffiths, 7008 N. Olney St., Indianapolis, IN (US) 46220

( * ) Notice: Subject to any disclaimer, the term of this patent is extended or adjusted under 35 U.S.C. 154(b) by 0 days.

(21) Appl. No.: 10/871,984

(22) Filed: Jun. 18, 2004

Related U.S. Application Data

(60) Provisional application No. 60/479,621, filed on Jun. 18, 2003.

(51) Int. Cl.
*F01L 1/34* (2006.01)

(52) U.S. Cl. ..... 123/90.16; 123/90.15; 123/90.27; 123/90.31

(58) Field of Classification Search ..... 123/90.16, 123/90.15, 90.27, 90.31, 90.17
See application file for complete search history.

(56) References Cited

U.S. PATENT DOCUMENTS 6,189,497 B1 2/2001 Griffiths
6,220,211 B1 4/2001 Line
6,230,675 B1 5/2001 Kobayashi et al.
6,234,125 B1 5/2001 Neubauer et al.
6,289,860 B1 9/2001 Speckhart et al.
6,357,406 B1 * 3/2002 Simpson ..... 123/90.16
6,484,675 B2 11/2002 Pierik
6,523,512 B2 2/2003 Axmacher et al.
6,578,534 B2 6/2003 Nohara et al.
6,591,802 B1 7/2003 Pierik
6,655,330 B2 12/2003 Pierik
6,659,053 B1 12/2003 Cecur
6,659,054 B2 12/2003 Sugiyama et al.
6,675,752 B1 1/2004 Kunne et al.
6,679,209 B2 1/2004 Hibi et al.
6,681,733 B2 1/2004 Ichimoto et al.
6,684,833 B2 2/2004 Moteki et al.
6,814,044 B2 * 11/2004 Elliott et al. ..... 123/198 C

OTHER PUBLICATIONS

Griffiths, *Variable Geometry Camshaft,* Brochure, Jun. 12, 2003.

* cited by examiner

*Primary Examiner*—Thomas Denion
*Assistant Examiner*—Zelalem Eshete
(74) *Attorney, Agent, or Firm*—Woodard, Emhardt, Moriarty, McNett & Henry LLP

(57) ABSTRACT

The invention improves volumetric efficiency of the internal combustion engine. A suspended cam, 1, follows a limited arc of rotation about the axis of a drive gear, 3. A change in engine speed (r.p.m.) activates the hydraulic piston 8, and alters the cam heel position along this arc that is tangent to a cam follower, 9. The separation distance, between the cam follower and cam heel, determines the duration of valve opening. The separation distance and the rocker arm ratio control the amount of valve lift. As the cam axis sweeps across the cam follower, there is coordinated movement of the cam follower fulcrum, 11. This tempers the otherwise excessive change in rocker arm ratio as the cam contact point on the cam follower moves in the "x" direction with rotation of the suspension assembly, 2. The rotation of the cam axis and gear reduction assembly, 4, 5, & 6, about the drive gear, shifts the timing of cam contact. This timing shift creates a desirable asymmetrical expansion or contraction in the duration period of valve opening.

5 Claims, 27 Drawing Sheets

INTAKE
EXHAUST
Fig. 1A
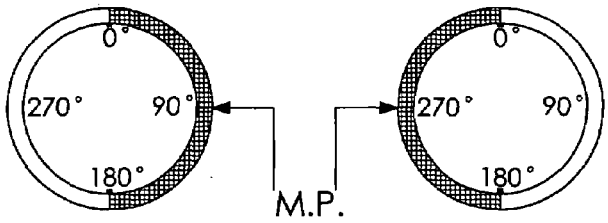
Fig. 2A
Fig. 1B
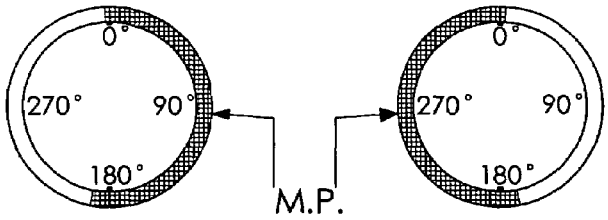
Fig. 2B
Fig. 1C
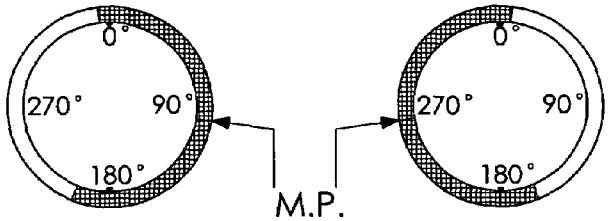
Fig. 2C
Fig. 1D
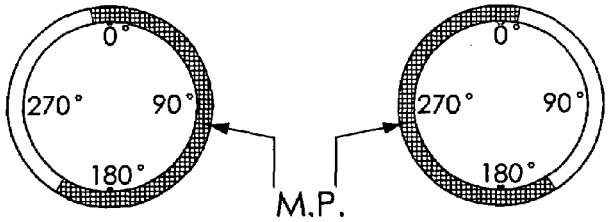
Fig. 2D
Fig. 1E
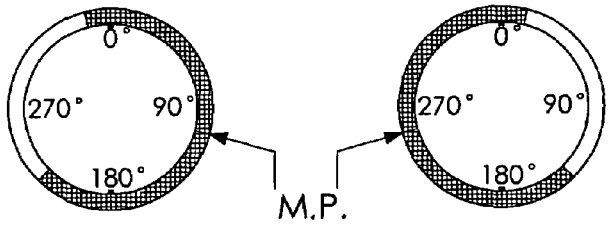
Fig. 2E INTAKE
EXHAUST
Fig. 3A
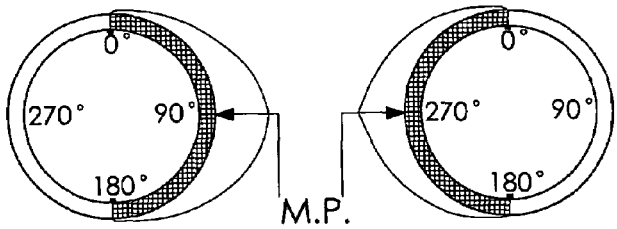
Fig. 4A
Fig. 3B
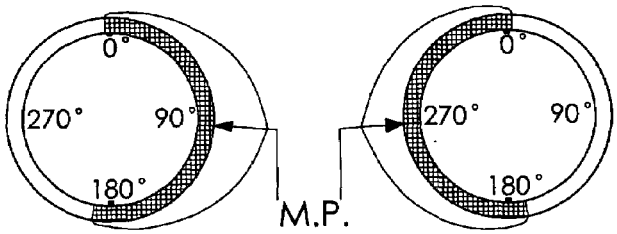
Fig. 4B
Fig. 3C
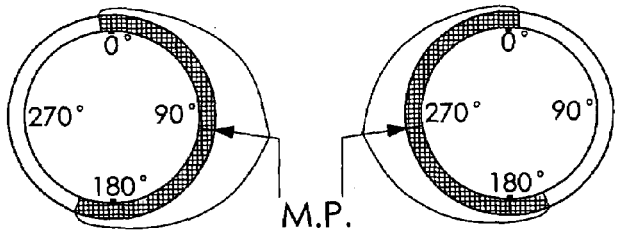
Fig. 4C
Fig. 3D
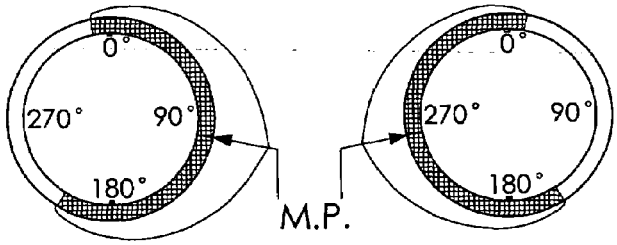
Fig. 4D
Fig. 3E
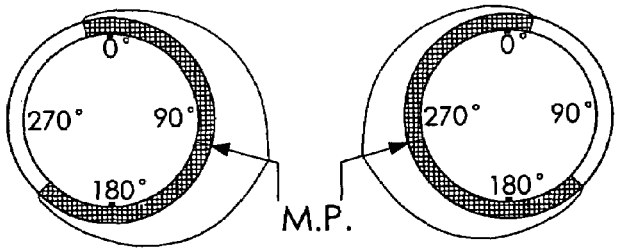
Fig. 4E INTAKE
EXHAUST
Fig. 5A
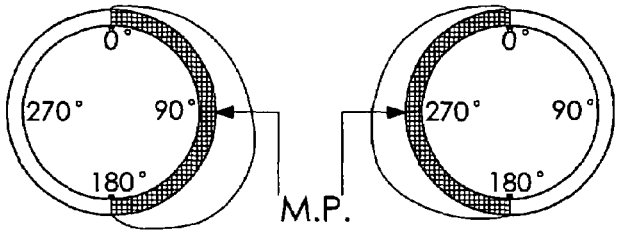
Fig. 6A
Fig. 5B
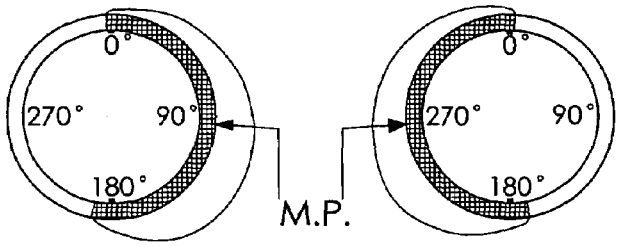
Fig. 6B
Fig. 5C
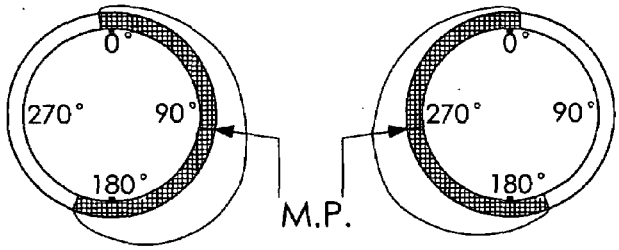
Fig. 6C
Fig. 5D
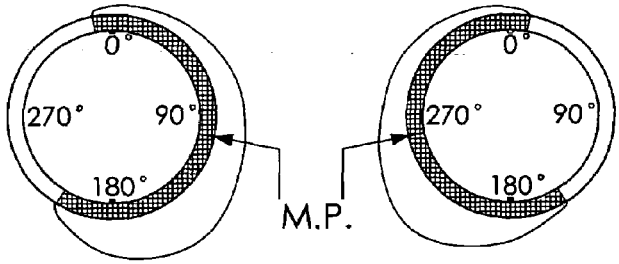
Fig. 6D
Fig. 5E
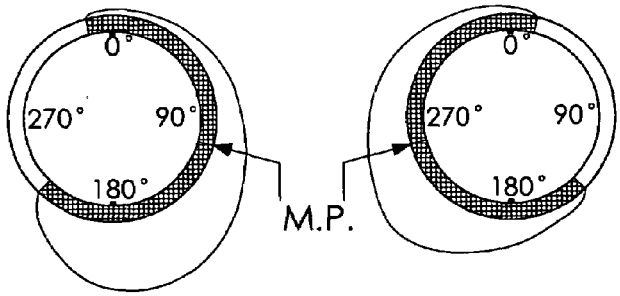
Fig. 6E

A CAMSHAFT GEAR-COUPLING VERNIER ON A V-TYPE ENGINE

A CAMSHAFT SPLINED DIVE SHAFT

Fig.15
$R_1 = 5R_2 \quad R_2 = R_3$
CAM LOBE RISE = $4R_2$
Fig.15A
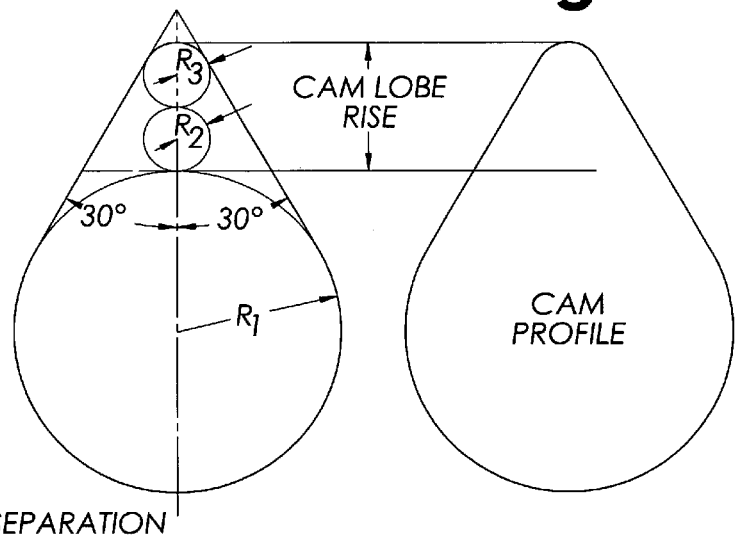
SEPARATION DISTANCE $= [\sin 45° (R_1 + 3R_2) + R_2] - R_1$
Fig.15B
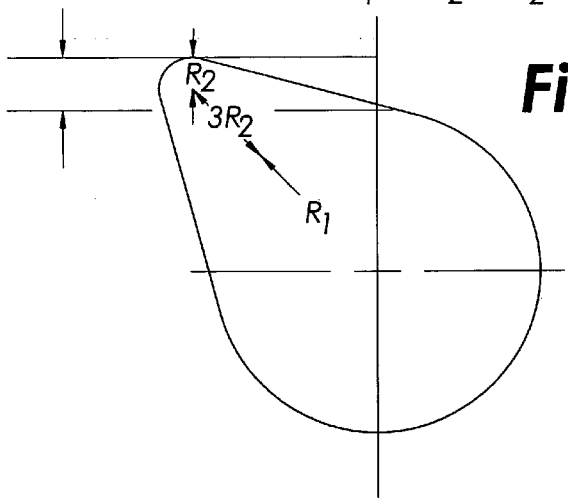

MAXIMUM VALVE LIFT
MEDIUM CRUISE POSITION

VARIABLE GEOMETRY CAMSHAFT

CROSS-REFERENCE TO RELATED APPLICATION(S)

The present invention claims the benefit of U.S. Provisional Patent Application No. 60/479,621, filed 18 Jun. 2003, which is hereby incorporated by reference.

TECHNICAL FIELD

The present invention relates to improving volumetric efficiency of an engine, particularly, but not exclusively, to improving volumetric efficiency using a variable geometry camshaft.

BACKGROUND OF THE INVENTION

All variable valve lift and timing mechanisms are designed with the objective of improving volumetric efficiency. A review of the tenets of cam design is presented to identify ideal valve operation and function across a range of engine rotation speeds. This summary also identifies the inherent compromises of fixed cam lobe design that must balance engine economy with output power. Using a "gold standard", for purposes of objective comparison, all devices that claim variable valve operation should be assessed in their ability to emulate ideal characteristics of operation and function over a range of engine speeds. The competing devices should then be judged by cost verses improvement to volumetric efficiency. The expense of integrating a variable valve operation device into production will include: the total number of device components, the sophistication level of material processing, the number of labor hours for assembly, and the dimension tolerances required for the components to meet design specifications.

A set of "pie" diagrams are shown in FIGS. 1*a* through 1*e*, for the intake valves and 2*a* through 2*e* for the exhaust valves beginning on page 39. The diagrams graphically depict the duration period of valve opening measured in degrees of crank rotation. Each diagram set, e.g. 3*a* & 3*b*, show volumetric efficient, intake and exhaust valve opening duration envelopes for each increasing stage of engine speed. FIG. 1*a* is a "pie" diagram of an intake valve that opens at Top Dead Center (T.D.C. 0°) and closes at Bottom Dead Center (B.D.C. 180°). The diagram depicts a valve opening duration of one hundred eighty degrees (180°) degrees. If not ideal, it is close to an ideal intake valve opening duration for idle speed. An intake valve opening duration envelope for medium cruise speed is shown in FIG. 1*c*. The valve opens eight degrees (8°) before T.D.C. and closes seventeen degrees (17°) after B.D.C; an opening period of two hundred five degrees (205°). 8°+17°+180°=205°. In FIG. 1*e* the valve opens fifteen degrees (15°) before T.D.C. and closes forty-five degrees (45°) after B.D.C.; two hundred forty degrees (240°) of crank rotation. 15°+180°+45°=240°. This is close to an optimum duration for high speed engine operation.

The "M.P." represents "Mid-Point" in the "Pie" Diagrams of FIGS. 1*a*–1*e* through 6*a*–6*e* covering pages 39, 40 and 41. The Mid-Point is the arithmetical half-way mark of the valve's opening duration relative to the degree period of crank shaft rotation. In a conventional camshaft arrangement the Mid-Point of the valve opening duration occurs when the valve achieves maximum lift off the valve seat at the half way point of rotation over the cam lobe. In the present invention, the Mid-Point of valve opening duration is not the rotation point of maximum valve lift. The Mid-Point is used as a mark of reference to compare the amount and direction of the timing shift between Two (2) valve opening duration envelopes.

In sequence, from FIGS. 1*a* to 1*e*, there is an asymmetrical expansion of the intake valve opening envelope into the exhaust and compression strokes of the engine. In the expanding progression of this graphical surrogate for the intake valve opening duration, there is greater encroachment by the envelope into the compression stroke than into the exhaust stroke. It is important to identify the degree amount of shift in the Mid-Point with respect to T.D.C.

In FIG. 1*a* the Mid-Point of the duration envelope is ninety degrees (90°). In FIG. 1*b*, location of the Mid-Point is close to ninety-four degrees (94°). The Mid-Point of the valve opening duration envelope continues to shift for FIGS. 1*c* and 1*d*. FIG. 1*e* shows the Mid-Point of the envelope has been retarded a total of fifteen degrees (15°); starting at ninety degrees (90°), FIG. 1*a*, and shifting to one hundred five degrees (105°) past T.D.C.

FIGS. 2*a* through 2*e* show the incremental expansion of a set of envelopes for the period of exhaust valve opening duration. As the exhaust envelope expands, its Mid-Point will shift direction opposite to the Mid-Point shift of the intake envelopes. In FIG. 2*a*, the Mid-Point is two hundred seventy degrees (270°) past T.D.C. In FIG. 2*b*, the Mid-Point of the duration envelope is close to two hundred sixty-six degrees (266°) past T.D.C. The duration envelope Mid-Point continues to shift through FIGS. 2*c* and 2*d*. In FIG. 2*e* the Mid-point of the exhaust valve envelope has shifted to two hundred fifty-five degrees (255°) after T.D.C. Following in a sequence, FIGS. 2*a* through 2*e* show an advance of the Mid-Point of the exhaust envelopes by fifteen degrees (15°).

Up to a point of diminishing returns, a greater level of valve lift from the valve seat poses less restriction to the flow of air or exhaust gases. FIGS. 3*a* through 3*e*, and FIGS. 4*a* through 4*e*, on page 40, show a series of "pie" diagrams with a profile graph of the valve lift adjacent to the duration envelopes. The lift profiles display the actual and relative levels of valve lift. The lift profiles also show the valve lift in relation to the valve opening envelope and the rotational position of the crankshaft.

Compare the lift profiles as an intake and exhaust set over FIGS. 3*a* and 4*a* through 3*e* and 4*e*. The amount of exhaust valve lift is usually two-thirds (⅔) of the intake valve lift. The exhaust valves open only to a level necessary to achieve substantial evacuation of the exhaust gases and not produce a back pressure on the ascending piston during the exhaust stroke.

FIGS. 3*a* through 3*e* and 4*a* through 4*e* show a symmetrical set of lift profiles across each of the duration envelopes. Maximum valve lift and the Mid-Point of each envelope is at the half way mark through the valve opening duration. FIGS. 5*a* through 5*e*, and 6*a* through 6*e*, on page 41, have asymmetrical valve lift profiles that will further improve volumetric efficiency. The intake valve lift profiles of FIGS. 5*a* through 5*e*, show the valve opening slowly and reaching maximum lift near the end of the duration envelope. Irrespective of engine speed, the optimum point for maximum intake valve lift occurs as the descending piston approaches B.D.C., where cylinder volume is not expanding by an appreciable amount.

During the intake stroke, the maximum piston velocity occurs when the crankshaft is at ninety degrees (90°) and the piston is half-way to B.D.C. At this crank position, the velocity of the air entering the cylinder lags behind the velocity of the piston. After the piston passes ninety degrees (90°), piston speed will decrease during its descent toward bottom dead center. During the second phase of the intake stroke, the increasing velocity of the air column entering the cylinder will exceeds the decreasing piston velocity. Efficient cylinder filling is optimized when the intake valve reaches its maximum lift at, or near, bottom dead center.

A variable valve device that emulates the duration envelopes and the intake lift profiles of FIGS. 5*a* through 5*e*, will improve the engine efficiency for several reasons. Although the compressed valve spring returns most of its stored energy to the rotating system, the longer period of cam rotation to maximum intake valve lift will reduce the power consumed internally to overcome spring resistance and reduce the losses from component friction.

With an increase in the engine rotation speed, the level of intake valve lift can be chosen to slightly restrict airflow into the cylinder. This restriction will increase the air velocity around the intake valve. The longer rotation period of the cam and the gradual rise of intake valves to maximum lift, provides an opportunity to use the high velocity airflow to create a more uniform dispersion of smaller fuel droplets within the cylinder.

At high levels of engine speed, the use of an asymmetrical lift profile also addresses the problem of time lost at the start of the valve opening envelope. As the intake valve opens there is a period of lost intake duration time due to the inertia of the stationary air column entering the cylinder. As engine speed increases to the high end of the r.p.m bandwidth, this time loss due to air column inertia poses a increasing detriment to volumetric efficiency. The problem is partially rectified by expanding the duration period of valve opening further into the exhaust and compression strokes to gain additional time to fill the cylinder.

Refer to the high speed "pie" diagrams of FIGS. 2*d* and 2*e*. A conventional camshaft, with a "2*d*" or "2*e*" type of valve envelope, will sacrifice a portion of the compression stroke as the intake valve remains open past B.D.C., and the piston has started its upward motion. One of the compromises of a conventional fixed cam is the loss of actual compression ratio at all engine speeds to assure an adequate filling of the cylinder at high r.p.m.

The Variable Geometry Camshaft expands the intake duration envelope into the compression stroke only as increasing engine speed would warrant the intrusion. The maximum available compression ratio can be used at idle, and the lower speeds of engine operation. During the operation of a V.G.C. engine at cruise levels and above, it is expected that the asymmetrical intake-valve lift profile of the invention will mitigate the amount of valve opening encroachment into the compression stroke. Over the bandwidth of engine operation speeds there is a less sacrifice of the compression ratio. The Variable Geometry Camshaft will continuously adjust the close of intake valves to improve volumetric efficiency and minimize the loss of actual compression at the higher levels of engine speed.

An optimum set of duration envelopes and valve lift profiles for the exhaust valves are presented in FIGS. 6*a* through 6*e*. The profiles show the exhaust valve opening quickly, maintaining a nearly constant level and then tapering off to closure. There is a benefit in opening the exhaust valve to maximum lift during the first phase of exhaust stroke to rapidly evacuate the gases from the cylinder. By minimizing cylinder pressure early with a wide open exhaust valve, less power is internally consumed in overcoming the back pressure from forcing waste gases out of the cylinder during the exhaust stroke. Unlike the intake valve, the rotation of the cam to engage the camfollower in close proximity to the fulcrum, offers a mechanical resistance to rapid lift of the exhaust valve. Fortunately, the amount of exhaust valve lift is generally less than the amount for the intake valve. It is also expected that due to the exhaust lift profile's gradual reduction of valve opening to closure, a spring with a lower coefficient of compression resistance can used without developing valve seat bounce at high r.p.m.'s.

With increasing engine speed, greater exhaust valve lift over an expanded opening duration is also used to offset the reduction in available time to evacuate the cylinder. For operation at idle speed, it is aimless to open the exhaust valve to a maximum level of lift. If the cam lobe is not required to overcome the greater resistance from full travel of the exhaust valve spring, there is a gain in economy due to the reduction of internal resistance.

To achieve nearly complete cylinder evacuation at higher levels of engine speed, the invention increases the point of exhaust valve opening before the piston reaches bottom dead center on the power stroke. The escaping exhaust gases produce a reactive force on the downward moving piston that is often referred to as the "kick." A rapid opening of the exhaust valve will maximize the amount of additional reactive force or "kick" on the piston before B.D.C.

A fixed camshaft requires compromises in the selection of lobe dimensions that limit volumetric efficiency to a narrow range of engine speeds. A design for a fixed cam lobe must balance the competing interests of economy and the ability to obtain high output power on demand. The Variable Geometry Camshaft provides an alternative to the inherent compromises of fixed cam valve timing, the level of valve lift and the extent of valve opening duration.

FIGS. 7*a* through 7*f*, show a cam lobe with a Thirty degree (30°) slope with respect to a centerline that extends through the camshaft axis to lobe apex. In FIGS. 7*a* through 7*f*, the cam heel and valve lifter are separated by a predetermined distance. This separation distance is close to half the maximum rise of the cam lobe. Following FIGS. 7*a* through 7*f*, the cam lobe rotates and the lifter reaches its maximum height in FIG. 7*c*. The maximum potential for valve lift is reduced by the separation distance between cam heel and lifter. In FIG. 7*e* the rotating cam loses its contact with the valve lifter. The cam's rotation, progressing from FIGS. 7*a* through 7*e*, will operate the lifter (and valve) over a ninety degree (90°) period. This is equivalent to one hundred eighty degrees (180°) of crankshaft rotation.

In FIGS. 8*a* through 8*f*, the space between the cam heel and the lifter surface is reduced from the amount shown in FIGS. 7*a* through 7*e*. In FIG. 8*a* the cam begins to exert a force on the lifter earlier in the cam's rotation with respect to FIG. 7*a*. With a reduced separation distance between the cam heel and the lifter, the lifter's maximum rise is now greater than the amount shown in FIG. 7*c*. With further rotation the cam lobe loses its contact with the valve lifter as shown in FIG. 8*e*. In FIGS. 8*a* through 8*e*, the duration period of cam lobe to lifter contact is one hundred five degrees (105°) of cam rotation; equivalent to two hundred ten degrees (210°) of crankshaft rotation.

In FIGS. 9*a* through 9*f*, the separation distance between the cam heel and lifter surface is now negligible. The point of cam lobe contact with the lifter (FIG. 9*a*) is now earlier than shown in either FIG. 7*a* or 8*a*. The increased rotational period of contact between cam lobe and valve lifter is one hundred twenty degrees (120°); or two hundred forty degrees (240°) of crankshaft rotation. With a minimum spacing between lifter and cam heel, the full height of the cam lobe is now impressed upon the lifter as shown in FIG. 9*c*.

The patent of Griffiths (U.S. Pat. No. 6,189,497) presented this method of changing valve lift and valve opening duration through the limited movement of the cam axis around a d-rive gear as shown in FIG. 10. The movement of the cam axis over a small arc is essentially a linear motion similar to the position change of the cam axis shown in FIGS. 7, 8 and 9.

The patent of Griffiths is an improvement over the limitations of a fixed dimension camshaft. This patent is, however, restricted in delivering an optimum level of volumetric efficiency. Notice that maximum valve lift occurs at the Mid-Point of the duration envelope. This method of cam to lifter engagement will produce lift profiles similar to FIGS. 3*a* through 3*e* and 4*a* through 4*e*. The previous patent is also limited by the length of the cam axis movement. This arc length is less than the-total amount of cam lobe rise. This limit on the cam rotation to asymmetrically shift the Mid-Point of an expanding or contracting valve opening duration envelope is therefore restricted. The limited cam rotation would require the components to meet high standards of dimension tolerance to achieve uniformity in valve operation.

FIG. 10 is a reprint from Griffiths that shows major device components. In FIG. 10, the ramp shaft is housed in the camshaft location within the engine and can rotate two hundred seventy degrees (270°) between stop positions. The graduated rise of the ramp has pushed the suspension bracket to rotate the cam four to eight degrees (4–8°) clock-wise around the drive gear. The cam heel has compressed the telescoping lifter. With cam rotation, the full amount of lobe lift is transferred to valve operation. As the ramp shaft is rotated clockwise, the return spring pulls the suspension bracket and cam away from the telescoping lifter. As the cam rotates to its contact point it must first compress the lifter and make up the distance that the cam axis has been displaced. At a rotation point where the valve lifter is fully compressed, further rotation of the cam will then begin to operate the valve. A change in the separation distance between the Two (2) piece lifter changes the amount of valve lift and opening duration.

The U.S. Pat. No. 6,189,497 provided the basic concept of permitting the cam axis to rotate in a limited arc to change the geometry of its interation with the valve train. The present invention offers a method of increasing the length of the arc of cam axis rotation. The present invention also coordinates an asymmtrical valve lift to suit the requirements of intake or exhaust operation. Moreover, the present invention offers a unique method of continuous mechanical control of all of the functions of variable valve operation.

SUMMARY OF THE INVENTION

The Variable Geometry Camshaft is capable of emulating a nearly ideal set of valve operation functions over a wide range of engine rotation speed. The invention delivers a continuous change to maximum valve lift, the timing of cam to valve contact and the duration of valve opening. The invention anticipates using a engine management system with feedback loops that sense environmental and operational conditions. E.M.S. output control signals can drive actuators to "fine tune" the position of the cam axis and cam follower fulcrum without compromising mechanical reliability.

To achieve maximum benefit, the invention should be integrated with a new head casting design. The V.G.C. head can then be mated to a conventional engine block casting and its rotating assembly. The components of the invention can be fabricated to be rugged and durable. The invention does not require the use of exotic materials or unusual methods of assembly. The invention may prove to be less complex and require fewer components than other mechanically based systems for variable valve operation. The invention is compatible with mass production technology, and, potentially, other innovations to improve the economy and power of the internal combustion engine.

The constituents of comprehensive valve operation include; the amount of maximum lift, the amount of minimum lift, the rate of the valve lift and the rate of its descent. Attaining optimum valve operation also requires adjusting the timing of the valve opening in relation to the crankshaft position (in degrees). The duration period of valve opening and the point of valve closing comprise a complete inventory of functions for comprehensive valve operation.

The Variable Geometry Camshaft (V.G.C.) permits a fluent adjustment to the valve operation of a four (4) cycle engine over a range of rotation speed. Volumetric efficiency is improved by adjusting the axial position of the cam and the rotational position of the cam lobe as it engages a cam follower. A coordinated change of position by the device components contributes to the continuous adjustment of each function of variable valve operation.

The invention teaches how to control the position change of three (3) sub-assemblies that vary the geometry of mechanical interaction between the cam lobe, the cam follower and the valve. The Variable Geometry Camshaft provides a continuous sixty degree (60°) asymmetrical expansion or contraction of the valve opening duration. This asymmetry is caused by a coordinated timing shift of cam contact with the cam follower. The invention can continuously control the valve's rate of ascent and descent. Asymmetrical lift profiles result in maximum lift of the intake and exhaust valves at, or near, bottom dead center. The V.G.C. also allows design diversity in choosing the operational range of maximum valve lift.

The valve lift is limited to an amount necessary for a given engine speed. This reduces the power consumed internally to overcome the spring resistance to cam rotation. A continuous and coordinated adjustment of all valve functions will improve the engine's volumetric efficiency. By eliminating the compromises of conventional fixed cam operation, a V.G.C engine gains fuel economy, reduces the exhaust emissions and increases its torque output.

The previous invention of Griffiths presented a method for improving the "breathing" capability of an engine. In U.S. Pat. No. 6,189,497, a camshaft is suspended about a drive gear. The cam axis position is controlled across a limited arc which is aligned with a telescoping lifter. Moving the cam axis position across this arc alters the timing of cam contact and release from a partially or fully compressed lifter. This position change of the cam axis changes the duration of valve opening and the valve lift.

Although U.S. Pat. No. 6,189,487, demonstrates a unique method of adjusting valve functions, the overall operation is not optimum. The length of the cam axis rotation about the drive gear is short in relation to the present invention. A sixty degree (60°) range of expansion or contraction of valve opening duration is controlled by only a four to eight degree (4–8°) rotation of the cam axis about the drive gear. In a multi-cylinder engine, this limited movement of the cam axis may yield an undesirable variance range with respect to the amount of lift for each valve and its opening duration. Moreover, the valve's lift and descent is symmetrical. Maximum lift for the intake valve occurs at a non-ideal crankshaft rotation point with respect to the descending piston during the intake stroke.

The novelty of the present invention is supported by an "x" and "y" cam axis movement over an arc that is three (3) times the length of the previous invention. The movement along the cam's "x" axis alters the location of cam lobe contact on the camfollower. The "y" axis motion of the cam adjusts the space between the cam heel and the contact surface of the cam follower. The "y" axis spacing, between cam heel and contact lever, sets the rotational position where the cam lobe begins to exert a force upon the cam follower to begin the period of valve opening.

The V.G.C. uses Four-to-One (4:1) gear reduction assemblies to drive suspended dedicated cams that sweep across twenty-four degrees (24°) of arc. The drive gear turns at twice the crank speed and the reduction ratio rotates the cam at one-half (½) the crank speed. Four degrees (4°) of cam movement along the arc causes the timing of cam to cam follower contact to be retarded or advanced by one degree (1°). An asymmetrical expansion or contraction of valve opening is produced by this timing shift in cam to cam follower contact. The cam follower is mounted on a sliding tower and its motion is aligned with the cam's movement on the "x" axis. Moving the cam along the "x" axis of the cam follower changes the mechanical advantage of the rocker arm lever on the valve. The position of the cam follower fulcrum is adjusted to augment or diminish the amount of valve lift with an increasing or decreasing duration of valve opening. The V.G.C. concept provides unique options in the design of valve operation characteristics. The intake valve can exhibit a wide range of maximum lift. The device can cause gradual opening of the intake valve with the achievement of maximum lift as the piston nears bottom dead center. The exhaust valve can be designed for quick opening to maximum lift and then taper to closure. The duration envelopes for intake and exhaust, in their contracted state, can be set up to exhibit negative valve overlap at idle speed. With an increase in engine speed, the expanding intake and exhaust envelopes will then exhibit an increased overlap condition. "Pie" diagrams are used to represent the functions of intake and exhaust valves over a range of engine speed and compare valve lift profiles with the rotation position of the crankshaft (in degrees).

The utility of the Variable Geometry Camshaft is based upon achieving functional goals of a system capable of:

1. Enhancing the ability of multi-cylinder production engines to significantly reduce idle speed rotation and thereby improve fuel economy, reduce exhaust emissions, and lessen internal friction and component wear, and,
2. Improving volumetric efficiency across the operational range of engine rotation speed and thereby increasing the engine's average torque output, and,
3. Increasing the Brake Mean Effective Pressure (B.M.E.P.) through the preservation of the engine's maximum available compression ratio at the lower speeds of engine rotation.

The utility of the Variable Geometry Camshaft is furthered by its ability to be adapted:

1. For mass production using existing engine block designs and rotating assemblies and requiring only the re-designing of cylinder heads, and,
2. For use with four (4) stroke internal combustion engines that burn gasoline, natural gas or diesel fuel, and,
3. And become integrated within the engine management system using digital and/or analog driven actuators that respond to the operational and environmental conditions that are sensed and directed by processor based feedback loops to further refine the mechanical changes in the valve timing, the valve lift and the valve opening duration.

The novelty of the present invention for a Variable Geometry Camshaft is based on the design features that:

1. Utilize a cam lobe profile with a constant numerical base relationship that set a standard for the calculation of component dimensions and distances within the system, and,
2. Expand the cam heel's arc of travel to be tangent to the cam follower contact lever and gain improved control over the engagement and interaction of device components using a Four-to-One (4:1) reduction gear assembly, and,
3. Use the rotation of the gear reduction assembly to create an asymmetrical timing shift that retards or advances the Mid-Point of the valve opening duration envelope during its expansion or contraction with changes in engine r.p.m., and,
4. Employ a sliding camfollower base that adjusts the fulcrum to a corresponding optimum position with partial rotation of the cam axis within the reduction gear assembly to create;
   a. an asymmetrical intake valve lift profile with a gradual rise to reach maximum lift as the descending piston approaches Bottom Dead Center, and,
   b. an asymmetrical exhaust valve lift profile with a rapid rise to reach maximum lift before the half-way mark of cam lobe contact and followed by a gradual tapering of valve lift to the closed position.
6. Provide flexibility to meet specific and general valve operation objectives over a range of engine speeds using equations to calculate the independent variables of: cam contact timing, cam dimensions, the arc limits of cam axis rotation, cam follower lever ratios, and the amount of coordinated position movement of the fulcrum.

DESCRIPTION OF THE DRAWINGS

FIGS. 1*a* through 1*e*—Pie Diagrams for the Intake valve.

FIGS. 2*a* through 2*e*—Pie Diagrams for the Exhaust valve.

FIGS. 3*a* through 3*e*—Pie Diagrams for the Intake valve with superimposed lift profiles.

FIGS. 4*a* through 4*e*—Pie Diagrams for the Exhaust valve with superimposed lift profiles.

FIGS. 5*a* through 5*e*—Pie Diagrams for the Intake valve with asymmetrical superimposed lift profiles.

FIGS. 6*a* through 6*e*—Pie-Diagrams for the Exhaust valve with asymmetrical superimposed lift profiles.

FIG. 15—Cam profiles based on five-to-one relationship of R1, base and R3, apex. Equations for determining the cam heel separation distance.

PREFERRED EMBODIMENTS OF THE PRESENT INVENTION

The present invention is based on the ability to control the mechanical interaction among Three (3) component sub-assemblies; 1.) a suspension bracket, camshaft, and gear reduction assembly, 2.) a camfollower contact lever, fulcrum, rocker arm, and sliding base assembly, and 3.) a valve, valve guide, valve spring, and valve piston assembly. The functions and contributions of these component sub-assemblies to the utility of the invention concept will be presented and described in the foregoing order.

Suspension Bracket, Camshaft, and Gear Reduction Assembly

Figure 11:
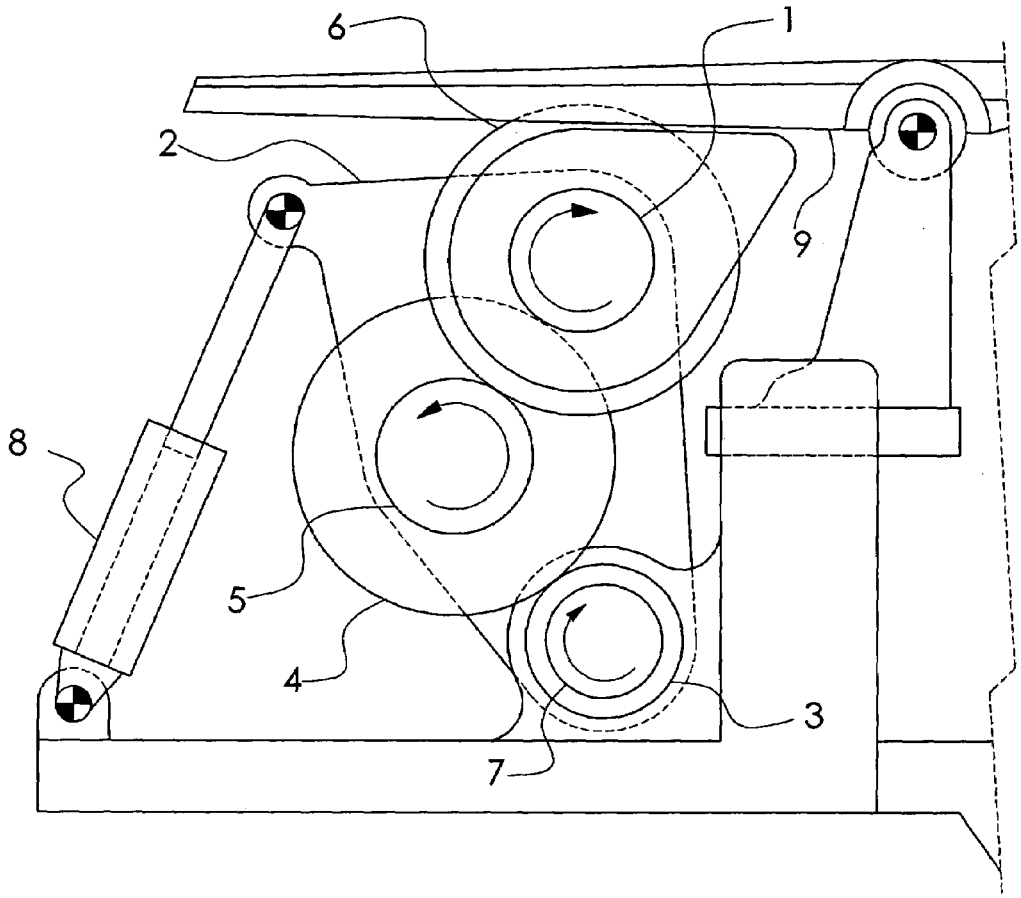

The V.G.C., or Variable Geometry Camshaft concept is based on the position of the cam axis, its contact location and its direction of engagement with a camfollower in Two (2) distinct orientations that assist either the intake or exhaust functions. FIG. 11, shows the position arrangement of components that are used for operation of the intake valve. The camshaft, 1, is housed within a suspension bracket assembly, 2, and driven by a Four-to-One (4:1) set of reduction gears. The drive gear, 3, rotates clockwise. The outer idler gear, 4, is engaged with the drive gear and will rotate counter-clockwise to produce a two-to-one (2:1) speed reduction. The inner idler gear, 5, is engaged with the cam gear, 6, to produce a second two-to-one (2:1) speed reduction. The camshaft, 1, rotates in a clockwise direction. The combined effect of two (2) sets, of two-to-one (2:1) speed reduction gears produces a four-to-one (4:1) speed reduction for the assembly.

Figure 12:
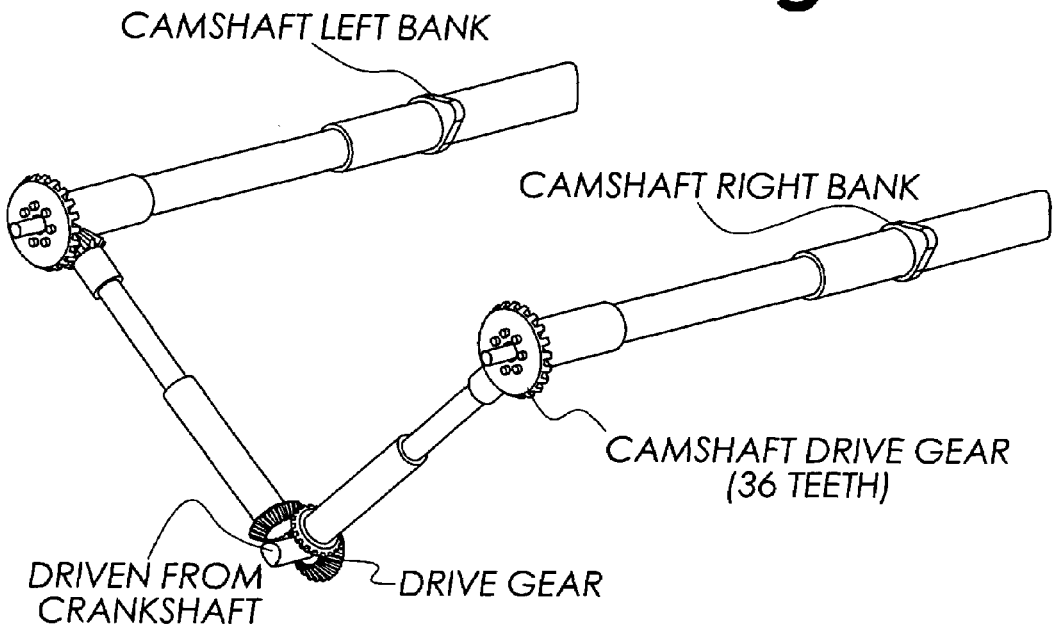
FIG. 12—Conventional aviation methods of driving over head camshafts.
Figure 12:
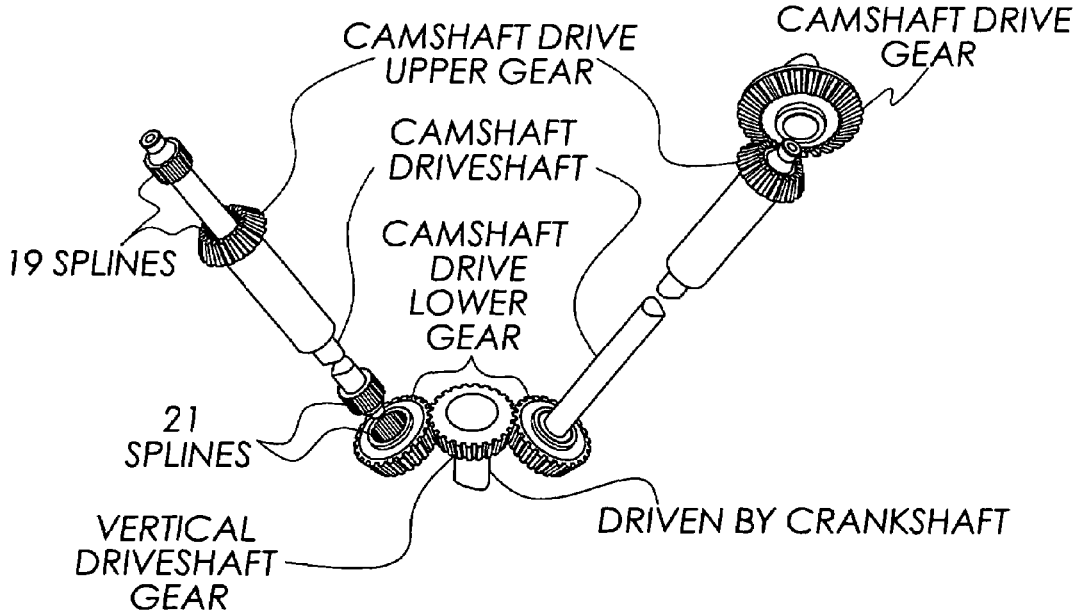

With the drive gear, 3, turning at twice the speed of the crankshaft, the Four-to-One (4:1) speed reduction will turn the camshaft at the usual one-half (½) of the crankshaft rotation speed. A drive shaft mechanism, similar to the examples shown in FIG. 12, is used to turn the drive gear at twice (1:2) the crank rotation speed. This method of driving the camshaft has been used extensively in aviation applications.

In a progression, FIGS. 13*a* through 13*e*, show a position change of the cam heel with respect to horizontal lines labeled as "Floor" and "Ceiling". The camshaft, gear reduction assembly and suspension bracket rotates around the drive gear shaft, 7, and across a limited arc of Twenty-Four degrees (24°). The axial position of the cam is controlled by the extension of a hydraulic piston, 8, to control the rotation of the suspension bracket and the position of the cam heel.

Figure 13A:
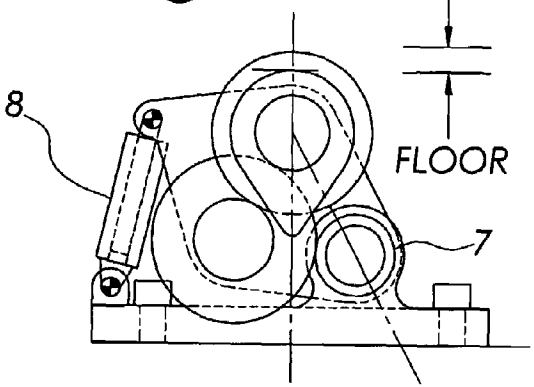
FIGS. 13*a* through 13*e*—Rotation of the cam, reduction gear and suspension-assembly; resulting change to cam heel position.
Figure 13B:
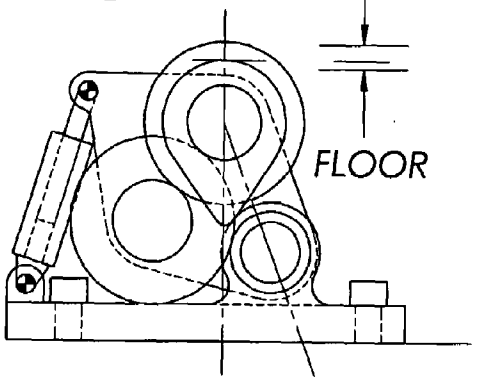
Figure 13C:
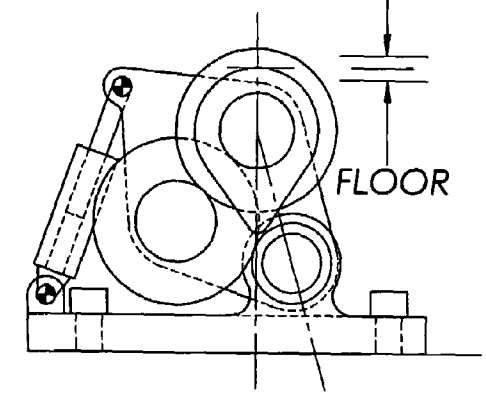
Figure 13D:
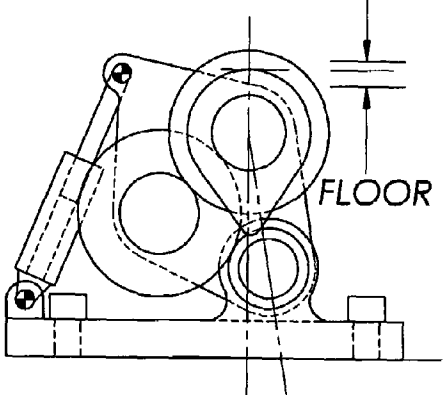
Figure 13E:
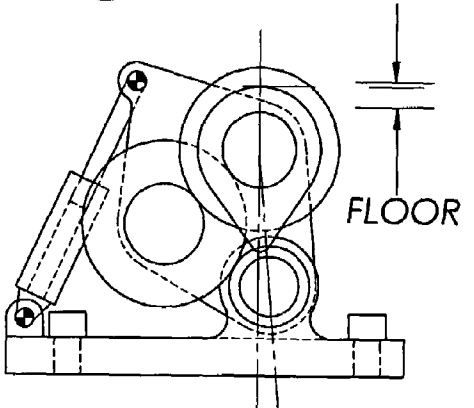

In FIG. 13*a* the cam heel is shown tangent to a horizontal line identified as the "Floor" position. In FIG. 13*b*, another horizontal line that is tangent to the cam heel has been elevated from the level shown in FIG. 13*a*. In FIGS. 13*c* through 13*e*, additional extension of the hydraulic piston has caused further rotation of the suspension bracket, camshaft, and gear reduction assembly. Continued rotation of the suspension bracket raises the position of the cam heel's horizontal tangent line up to the "Ceiling" limit of FIG. 13*e*. The degree amount of cam axis travel is a design variable. The invention anticipates that the amount of cam axis travel can be greater or lesser than the arc of Twenty-Four degrees (24°) used in this example.

With an extension of the hydraulic control piston, 8, the bracket, 2, and cam, 1, rotate in the same clockwise direction as the drive gear. A full extension of the hydraulic piston moves the cam axis across the limited arc of Twenty-Four degrees (24°). The timing of cam lobe engagement with the camfollower contact lever, 9, in FIG. 11, will be retarded or delayed by Six degrees (6°); 24° (degrees of arc) divided by 4 (gear reduction ratio)=60. The two-to-one (2:1) gear ratio between crankshaft and camshaft rotation causes the Mid-Point of the envelope for intake valve duration to be retarded up to twelve degrees (12°) of crankshaft rotation. This twelve degrees (12°) of cam contact timing shift is only three degrees (3°) less than the ideal amount identified for the asymmetrical expansion and contraction of the intake envelopes of FIGS. 5*a* through 5*e*.

Figure 14:
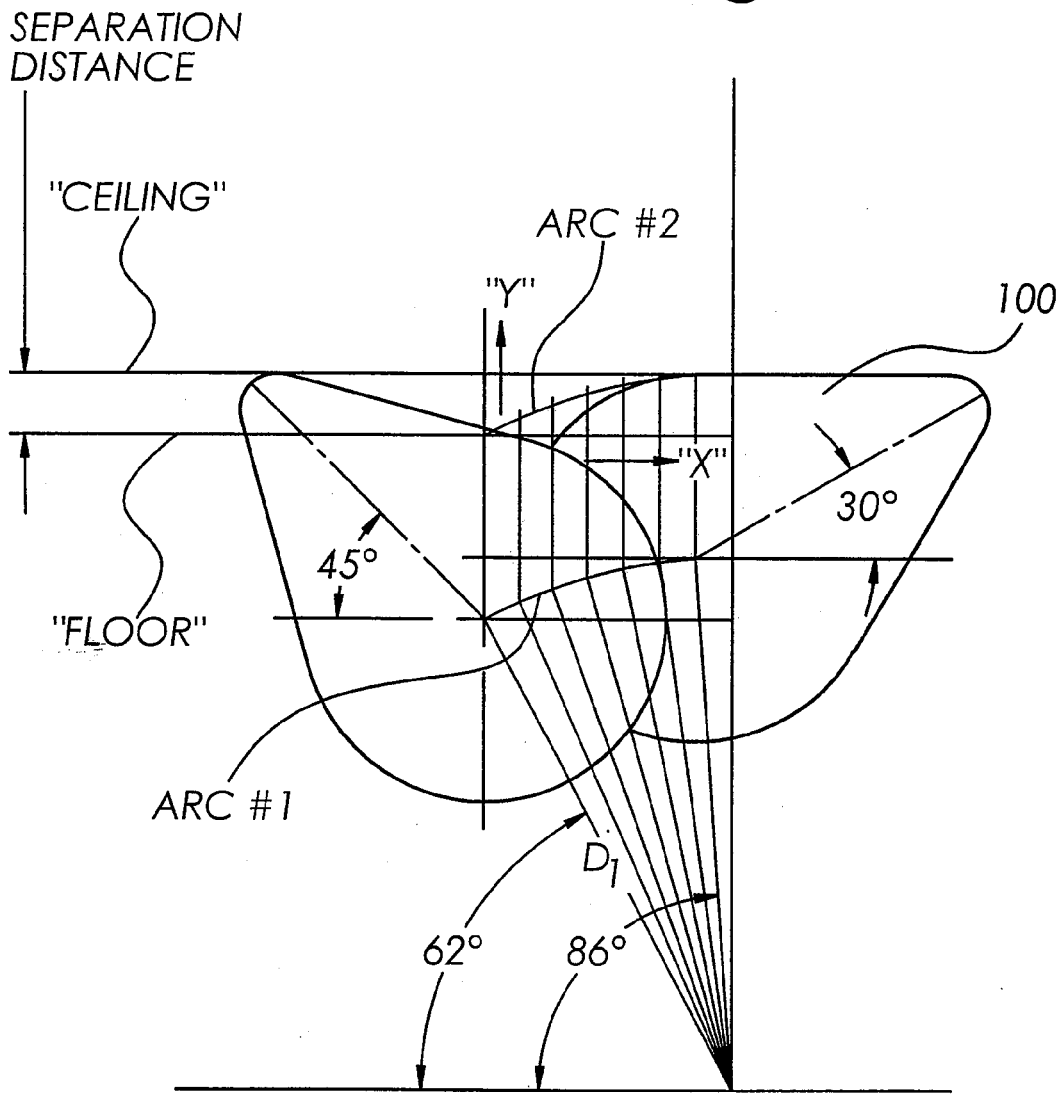
FIG. 14—Movement of the cam heel across Arc # 2 with rotation around the axis point of the drive gear.

FIG. 14, presents in detail the Twenty-Four degrees (24°) of limited arc that represents the full range of cam axis motion across Arc #1. The amount of rotation (degrees) by the cam axis across Arc #1, will determine the amount of advance or retarding of the valve timing. FIG. 14 also shows a second arc of interest that is traced by the cam heel with a partial rotation of the cam axis and gear reduction assembly. As the cam axis rotates around the drive gear, there is a corresponding position change by the cam heel along Arc #2. Throughout the operational range of engine rotation speeds, the position of the cam heel along Arc #2 is on, or between, the horizontal "Floor" and "Ceiling" boundary lines that run tangent to the arc traced by the cam heel.

FIG. 14 also shows an "x" and "y" Cartesian map of the cam heel movement along Arc #2. Rotation of the suspension bracket in its progression from FIGS. 13*a* through 13*e*, causes greater horizontal movement of the cam heel along the "x" axis than the amount of vertical movement along the "y" axis. Greater motion of the cam heel along the "x" axis improves the regulation of the separation distance between the cam heel and the camfollower contact lever. This will foster uniformity in the amount of valve lift and the valve opening duration for multi-cylinder engines.

FIG. 15 shows a side profile of the cam lobe. Note that the circle of radius $R_1$ is five (5) times the radius of $R_2$ or $R_3$. With the centers of $R_1$, $R_2$, and $R_3$, plotted along a center line, and each circle tangent to an adjacent circle, a thirty degree (30°) slope can be drawn from the center line to be tangent with the edge of the circles formed by $R_1$ and $R_3$. This profile is used as the outline of the cam lobe in the present invention. The amount of lobe rise of the cam will be equal to:

$$2(R_2)+2(R_3)=\text{Lobe Rise}$$

Because $R_2=R_3$; Lobe Rise=$4(R_2)$. Therefore, Cam Lobe Rise from Axis=Lobe Rise+$R_1$=$4(R_2)+R_1$ To calculate the appropriate amount of separation distance between the cam heel and cam follower, the graphical relationship is shown in FIG. 15 and the equations are as follows:

$$\text{Cam Lobe Rise From Axis @ } 45° = [\text{sine } 45°(3R_2 + R_1) + R_2]$$

$$\text{Separation Distance} = D_S = (\text{Cam Lobe Rise From Axis @ } 45°) - R_1,$$

$$D_S = [\text{sine } 45°(3R_2 + R_1) + R_2] - R_1,$$

$$D_S = [.7071(3R_2 + R_1) + R_2] - R_1,$$

$$D_S = [2.121R_2 + .7071R_1 + R_2] - R_1,$$

$$D_S = [3.121R_2 - .2929R_1].$$

By substituting for $R_1$, the value of $D_S$ can be calculated in terms of $R_2$.

Because: $R_1=5(R_2)$ $$D_S = [3.121R_2 - 5(R_2) \times .2929],$$

$$D_S = [3.121R_2 - 1.464R_2],$$

$$D_S = 1.657R_2.$$

In cam 100 the centerline from the cam axis through the apex of the lobe is thirty degrees (30°) from horizontal and one side of the lobe runs parallel to the ceiling line. Graphically it appears that there is no separation distance between the cam heel and the ceiling line. This is proven by:

$$\text{Separation Distance @ } 30° =$$

$$D_S \text{ @ } 30° = [\text{sine @ } 30°(R_1 + 3R_2) + R_2] - R_1$$

Substituting for $R_1$:

$$R_1 = 5(R_2)$$

$$D_S \text{ @ } 30° = [.5(5R_2 + 3R_2) + R_2] - 5R_2$$

$$D_S \text{ @ } 30° = [.5(8R_2) + R_2] - 5R_2$$

$$D_S \text{ @ } 30° = [5R_2] - 5R_2 = 0$$

FIG. 14 shows the relationship between the separation distance and the dimension for $D_1$; the distance between the drive gear axis and the cam axis. For this example, the cam axis will rotate twenty-four degrees (24°) about the drive gear. The lower limit of this arc of motion is sixty-two degrees (62°) from the horizontal reference line. The upper limit of the arc is eighty-six degrees (86°) from horizontal. Separation Distance is then:

$$\text{Separation Distance}=D_S=(\text{sine } 86°(D_1)+R_1)-(\text{sine } 62°(D_1)+R_1)$$

$$D_S=\text{sine } 86° (D_1)-\text{sine } 62°(D_1)$$

$$D_S=D_1 [\text{sine } 86°-\text{sine } 62°]$$

$$D_S=D_1 [0.9976-0.8829]=D_1 [0.1146]$$

Solving for $D_1$:

$$D_1 = \frac{D_S}{0.1146}$$

Substituting for $D_S$ using the result from the previous set of equations:

$$D_1 = \frac{[3.121R_2 - .2929R_1]}{0.1146}$$

$$D_1=27.234 R_2-2.556 R_1$$

Substituting for $R_1$; $R_1=5(R_2)$ $$D_1=27.234 R_2-5(R_2)\times 2.556$$

$$D_1=27.234 R_2-12.78 R_2=14.454 R_2$$

Figure 16:
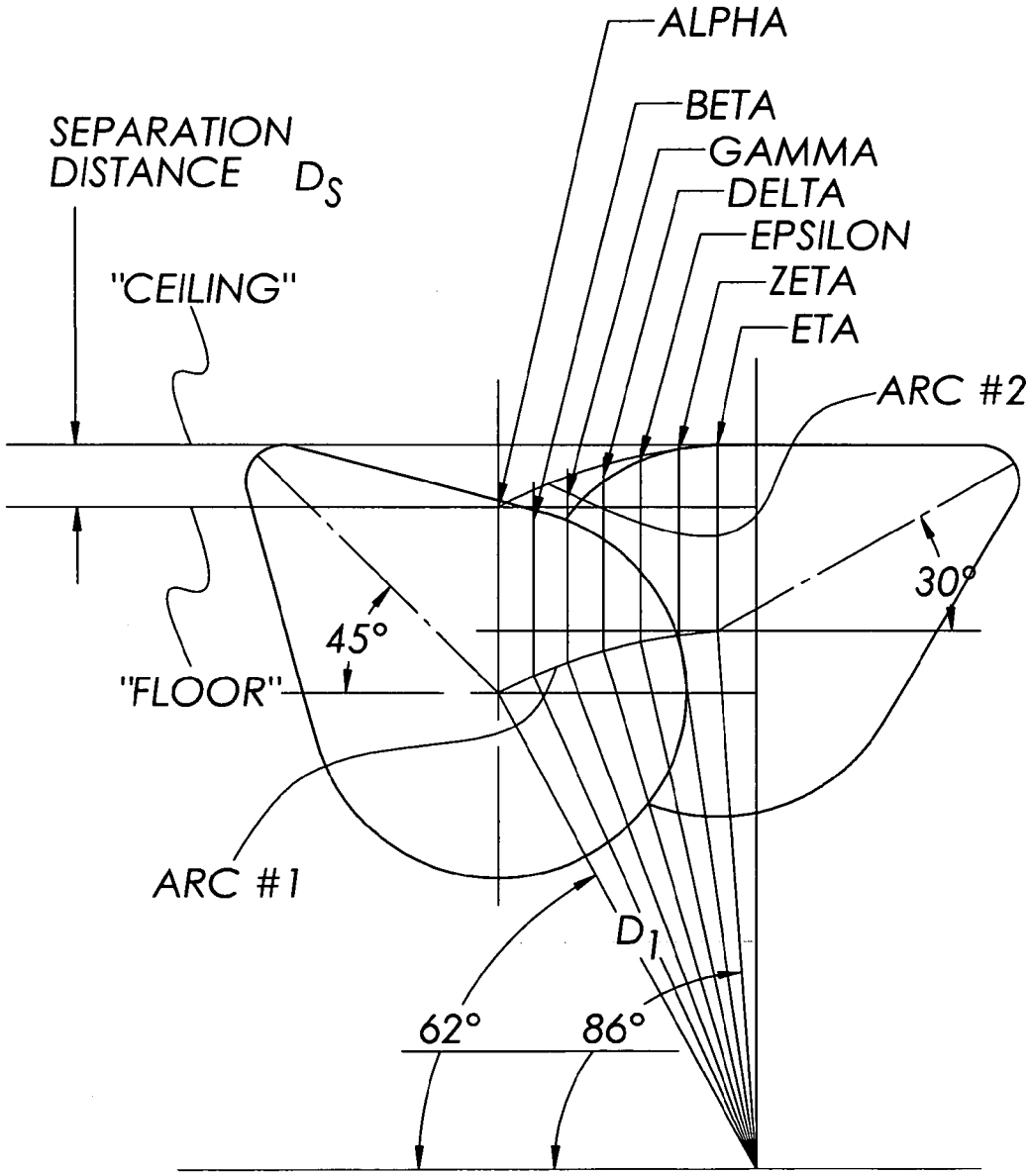
FIG. 16—Identification of incremental cam heel positions across Arc #2.

FIG. 16, page 51, shows a vertical reference line that extends from the shaft axis of the reduction drive gear and intersects at a right angle with the "ceiling" line. This "ceiling" line will be replaced by the cam follower contact lever. A horizontal line of reference extends outward from the axis of the drive gear. The upper and lower limit lines of Arc #1, for the partial rotation of the cam axis around the drive gear, are based on this reference line. The lower limit line for the cam axis extends outward from the drive gear shaft axis, 7, at sixty-two degrees (62°) from horizontal. The cam axis upper limit line extends outward from the drive gear axis at eighty-six degrees (86°) from horizontal. The amount of degree rotation of the cam axis around the drive gear is the difference of the two (2) limit lines; twenty-four degrees (24°).

Arc # 2 is the path that is traced by the highest point on the cam heel as the cam axis rotates around the drive gear. The lower and upper limit lines of Arc #2, along with the "Floor" and the "Ceiling" lines, enclose the rotational position of the cam heel.

FIG. 16 shows five (5) intermediate positions of the cam heel along Arc #2 as the cam axis moves between upper and lower limits of Arc #1 rotation. Starting at the lower limit of sixty-two degrees (62°) from horizontal, the intermediate cam positions are four degrees (4°) apart. These arbitrary cam heel positions are identified by the greek letters in FIG. 16 and Table 1, page 35, at the end of the text. By calculating the amount of separation distance at each cam heel position, the amount of valve opening duration can be determined. With an accounting for cam rotation around the drive gear at each cam heel position, a "pie" diagram can be created showing valve opening duration and the shift in the duration envelope. At the idle speed "alpha" position, the cam lobe centerline is forty-five degrees (45°) from vertical. The amount of cam lobe contact during its full rotation is ninety degrees (90°). This yields a total valve opening duration of one hundred eighty degrees (180°) of crankshaft rotation. Lobe lift applied to the cam follower contact lever is calculated as:

$$\text{Lobe height}=4R_2$$

$$\text{Lobe lift @ } (45°)=4R_2-\text{Separation Distance Forty-Five degrees}$$

Substituting for the Separation Distance in terms of $R_2$; $D_S$ 1.657 $R_2$ $$\text{Lobe lift @ } (45°)=4R_2-1.657\ R_2=2.343\ R_2 \text{ Forty-Five degrees}$$

Using sine functions for the upper and lower limits of the Arc #1, an interpolation is made to determine separation distance at the beta position of sixty-six degrees (66°) from horizontal.

$$\text{sine } (86°)\ (0.997564)-\text{sine } (62°)\ (0.882948)=0.1146$$

$$\text{sine } (66°)\ (0.9135)-\text{sine } (62°)\ (0.8829)=0.0306$$

$$\frac{\%\text{ of sine increase}}{100}=\frac{.0306}{.1147}$$

$$\%\text{ of sine increase}=26.7\%$$

This percentage of sine function increase also represents the percentage decrease in the separation distance at the beta position of the cam heel. Because the available separation distance at the alpha position is:

$$D_S=1.657\ R_2,$$

$$\text{then; } D_S \text{ beta}=(73.3\%)\ 1.657\ R_2=1.214\ R_2,$$

Using a previous equation the known amount of the sine function is replaced by the unknown sine (theta)°:

$$D_S \text{ beta}=[\text{sine (theta)}°\ (3R_2+R_1)+R_2]-R_1,$$

$$\text{And because: } R_1=5R_2$$

$$1.214\ R_2=[\text{sine (theta)}°\ (3R_2+5R_2)+R_2]-5R_2$$

$$5.214\ R_2=\text{sine (theta)}°\ (8R_2)$$

$$\frac{5.214R_2}{8R_2}\text{sine(theta)}^{\circ}=.6517$$

$$\text{Therefore: arc sine } (0.6517)=(\text{theta})°=40.67°$$

$$\text{Lobe lift @ } (40.67°)=4R_2-1.214\ R_2=2.786\ R_2, \text{ Forty and } 67/100$$

Using the above method for each of the intermediate cam positions, the variables of duration period and lobe lift can be tabulated as a step towards producing a set of "pie" diagrams. Table 1 and 2, at the end of the text, lists the calculated values of cam operation for each of the cam heel positions identified in FIG. 16.

The sine function of the last four or five degrees (4–5°) before vertical, limits the cam heel to a minimal rise in closing the separation distance between the cam heel and the cam follower. If the upper limit position of cam heel travel along Arc #2 was the vertical reference line, the period of valve opening duration would have nearly reached full expansion at a position of five or six degrees (5–6°) before the vertical limit. The desired amount of cam contact timing shift would lag too much behind the expansion of the duration envelope. Choosing the upper limit position of Arc #1 to be four degrees (4°) before vertical helps to synchronize the desired amount of cam contact timing shift with the expanding or contracting valve duration envelope. The relationship between the cam lobe profile shown in 14*a*, the separation distance, $D_S$, and the distance between the drive gear axis and cam axis, $D_1$, provides the foundation for the selection or derivation of all other component dimensions of the invention.

Cam Follower, Fulcrum, Rocker Arm and Sliding Tower Assembly

Figure 17:
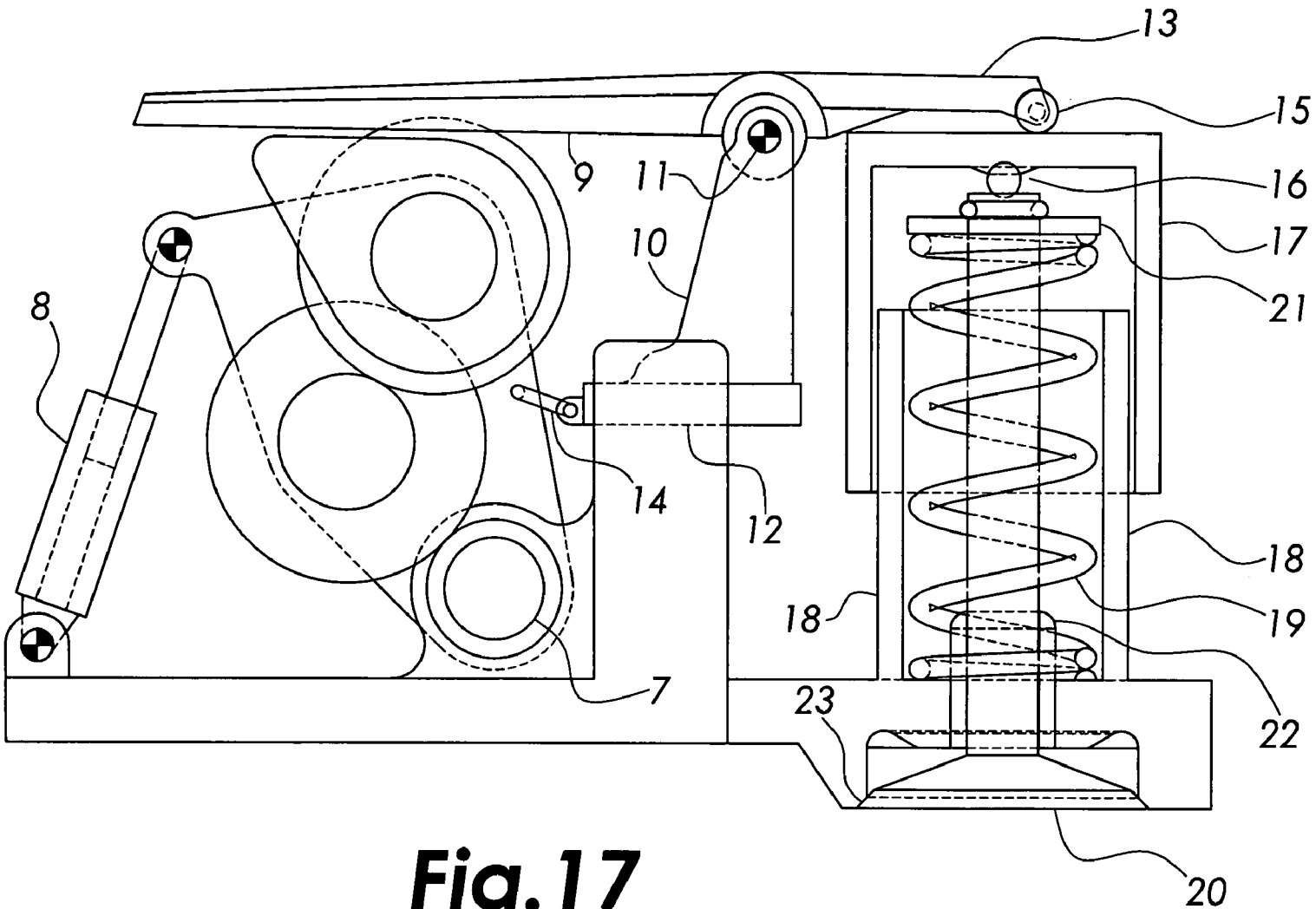
FIG. 17—Side view of complete device for intake valve operation.

FIG. 17, shows in detail the cam follower tower, 10, fulcrum, 11, and the intake valve train. The fulcrum position is adjusted as the cam follower tower slides on a guide track, 12.

The cam follower is a first class lever. The cam follower fulcrum separates the cam follower contact lever, 9, and the rocker arm lever, 13, that operates upon the valve assembly. FIG. 17 shows the cam follower contact lever, 9, has replaced the horizontal "Ceiling" line identified in FIGS. 13 and 14. FIG. 17 also shows the suspension bracket tied to the cam follower base with a tie rod, 14. With a rotation of the suspension bracket, the tie rod causes the cam follower and fulcrum to shift position. This maintains a more constant rocker arm lever ratio by mitigating the change of distance between the fulcrum and cam lobe's point of contact on the cam follower.

Figure 18A:
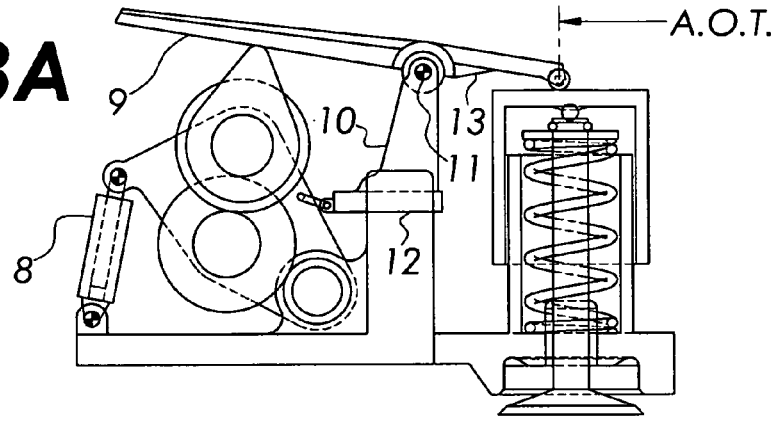
FIGS. 18*a*, 18*b* & 18*c*—Three levels of extension by the hydraulic actuator, a fixed cam position and the resulting change in valve lift.
Figure 18B:
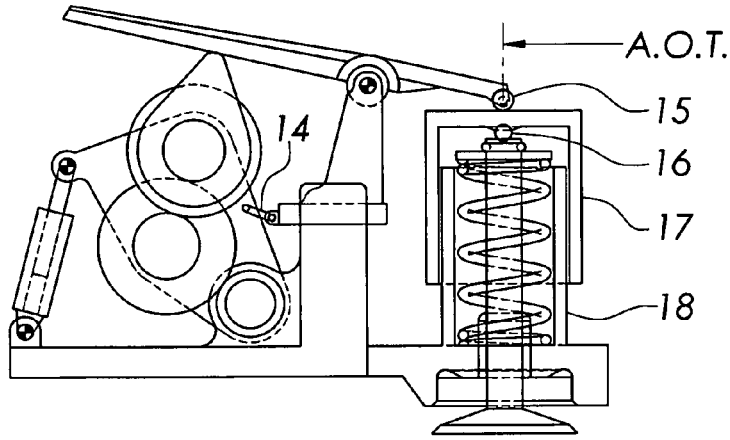
Figure 18C:
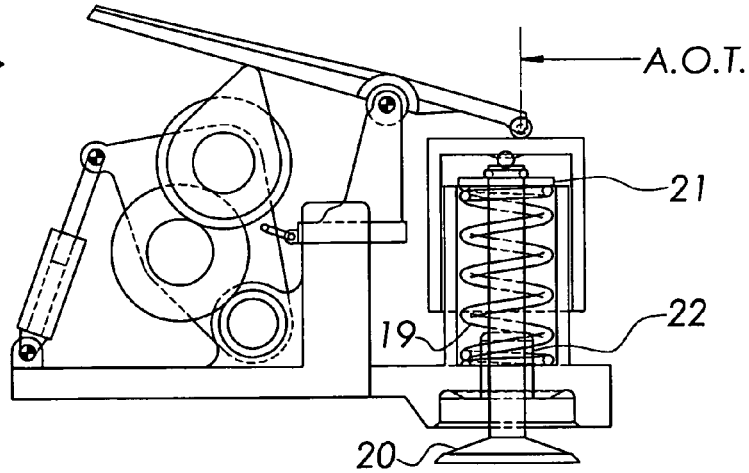

The coordinated movement of the cam follower tower prevents an unacceptable change in the rocker arm ratio due to the significant movement of the cam axis along the "x" axis as shown in FIGS. 18*a* through 18*c*. The linear movement of the fulcrum can be chosen to be less than the amount of "x" direction movement of the cam axis. Additional cam lobe rise can be combined with an small increase in the rocker arm ratio to augment the valve lift at higher levels of engine speed. The amount of linear movement of the fulcrum, determined by connection points on the cam follower base and suspension assembly, is another independent variable that can be chosen according to the design requirements.

Figure 19:
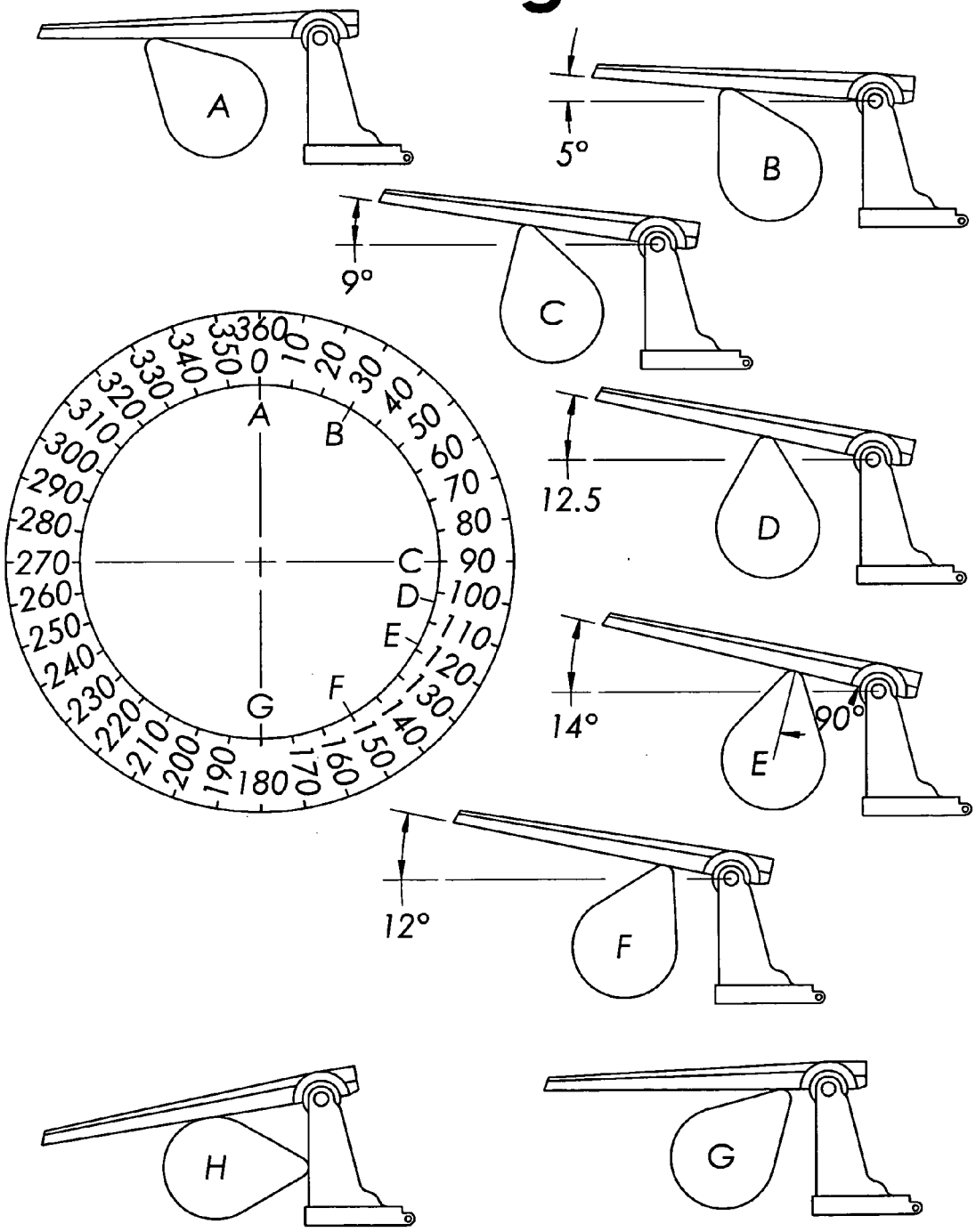
FIG. 19—Determining maximum deflection of the intake valve cam follower through full rotation of the cam.

Further gains in volumetric efficiency will be realized with maximum deflection of the contact lever, and maximum valve lift, occurring after the half-way mark of cam to cam follower contact. FIG. 19 is a diagram showing the actions of the cam lobe against the contact lever. FIG. 19 shows the cam lobe with initial contact at the start of the intake stroke. With a cam rotation though the positions A, B and D shown in FIG. 19, there is an increasing deflection of the contact lever. Position E shown in FIG. 19 shows the maximum deflection of the contact lever occuring when a right angle is formed between a centerline extending outward from the cam lobe apex and the contact surface of the cam follower. Maximum deflection of the contact lever occurs when the cam lobe is fifty-nine degrees (59°) through its ninety degrees (90°) of contact with the cam follower. This is equivalent to a crankshaft rotation point of one hundred eighteen degrees (118°).

Position F of FIG. 19 shows the cam lobe position has rotated another sixteen degrees (16°) where the crankshaft position will be one hundred fifty degrees (150°) past top dead center. The amount of deflection of the contact lever remains close to its previous maximum level and the piston position is now five-sixths (5/6) of the distance through the intake stroke. At this point, the rate of cylinder expansion is rapidly decreasing and the intake valve remains open to more than eighty percent (80%) of maximum lift.

The ability of the device to deliver maximum lift to the intake valve during the second phase of cam lobe contact is due to the employment of the sliding fulcrum working in concert with the rotation of the cam and gear reduction assembly. The cam lobe is released from the contact lever in close proximity to the fulcrum throughout the range of cam axis and gear assembly rotation around the drive gear. The invention produces a lift profile of intake valve operation that corresponds to the ideal lift profiles that are shown in the "pie" diagrams of FIGS. 5 and 6.

Valve, Valve Spring, and Valve Piston Assembly

FIG. 17 shows the rocker arm roller, 15, the valve bearing 16, the valve piston, 17, the valve cylinder, 18, the valve spring, 19, the valve, 20 and the valve plate, 21. FIGS. 18*a* through 18*c*, show the device components achieving maximum lift at three (3) distinct positions of cam and suspension assembly rotation with a coordinated linear change of location by the fulcrum. In each of the positions shown in FIGS. 18*a* through 18*c*, the cam lobe has rotated to provide maximum deflection of the cam follower. In FIG. 18*a*, the hydraulic actuator, 8, is fully retracted and the suspension assembly and cam follower base are at the idle speed position. The amount of maximum valve lift is relatively small. A curved line, the Arc of Travel (A.O.T. in FIG. 18), follows the motion of the rocker roller, 15, and shows the relative amount of lever action that depresses the valve piston, 17, and valve, 20.

The Arc of Travel by the rocker arm is essentially linear and nearly parallel to the center line of valve travel. FIG. 18*b* shows the cam and gear reduction assembly has partially rotated along with a shift in the fulcrum position. The starting position of the rocker arm roller on the piston face has been relocated toward the center of the valve piston. In relation to FIG. 18*a*, the Arc of Travel of FIG. 18*b* shows a greater movement of the rocker arm roller and an increase of the intake valve lift.

FIG. 18*c* shows the device component interactions for engine operation at the higher levels of rotation speed. The deflection of the rocker arm will be larger due to a closing of the separation distance and the nearly full rise of the cam lobe upon the cam follower contact lever. Moreover, the release position of the cam lobe is closer to the fulcrum. The travel of the fulcrum and sliding tower has moved the resting position of the rocker arm roller out of the center of the valve piston. The curvature and length the Arc of Travel by the rocker arm roller to maximum lift, will draw the roller contact point back into the center of the valve piston. The lateral forces from the operation of the rocker arm are dispersed across the contact surfaces of the valve piston, 17, and the valve piston cylinder, 18. This employment of a valve piston and cylinder will reduce wear on the valve guide, 22, and maintain proper alignment and contact between the valve, 20, and the valve seat, 23. The rocker arm roller can be slightly offset on the valve piston to cause a gradual rotation of the valve piston around the valve cylinder and avoid a stationary wear pattern.

Exhaust Valve Operation

Figure 20:
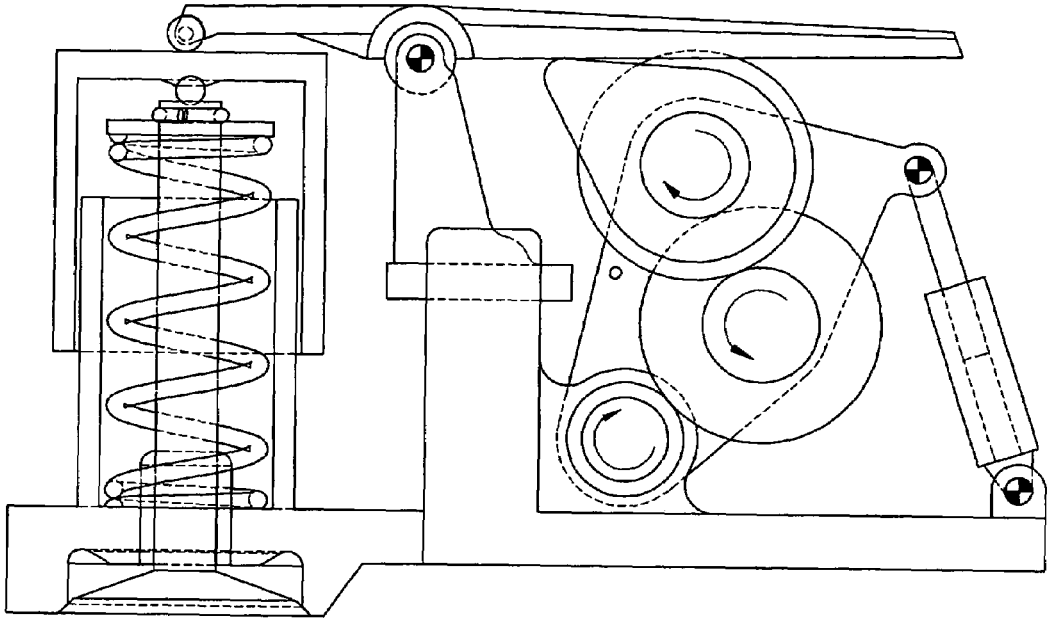
FIG. 20 Side view of exhaust valve device showing direction of drive gear and cam rotation with respect to the cam follower.
Figure 21:
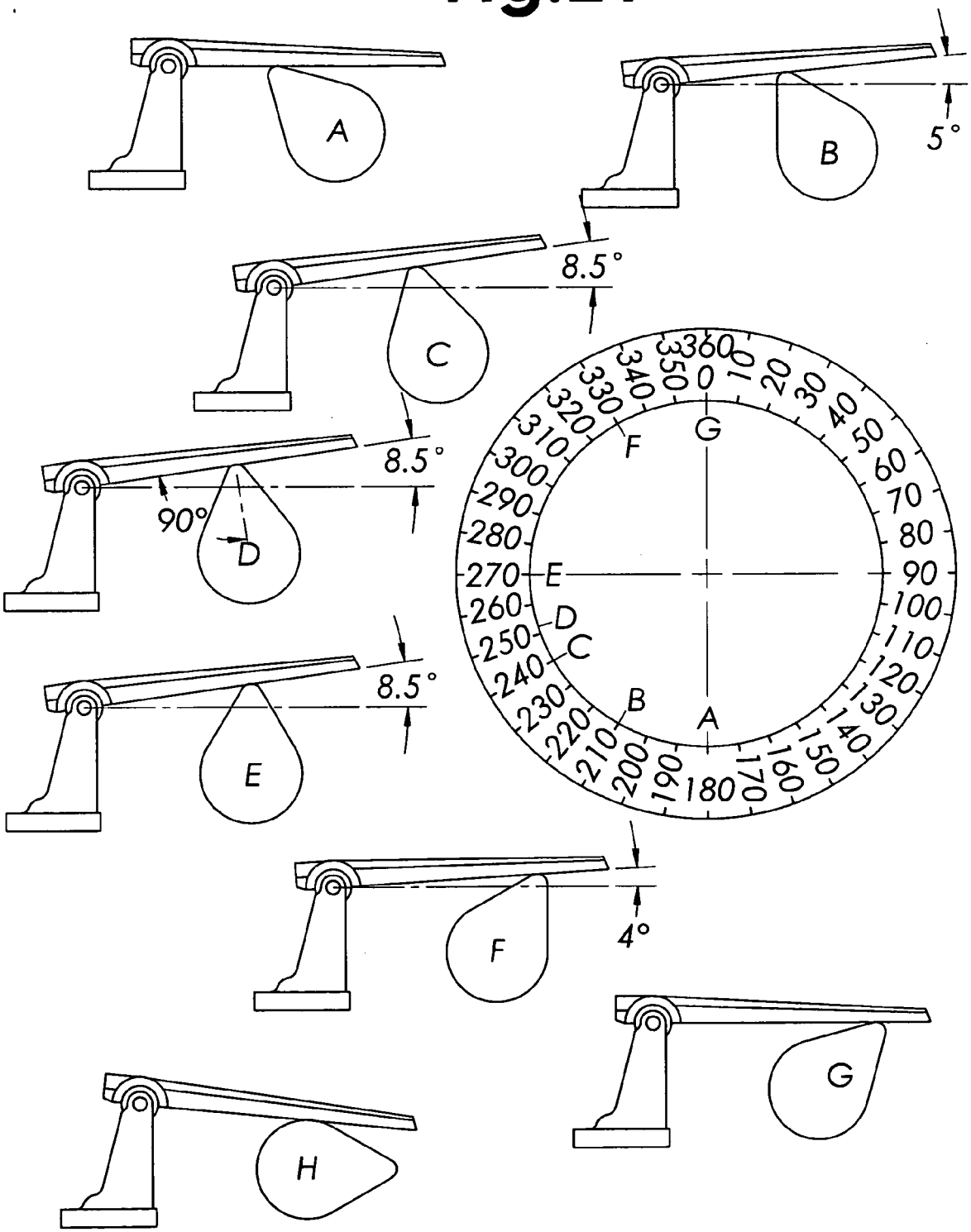
FIG. 21—Determining maximum deflection of the exhaust valve cam follower through full rotation of the cam.

In FIG. 20, the location of the gear reduction assembly, cam follower and exhaust valve appear as a mirror image to the arrangement of the intake valve components. Notice that the drive gear of the suspension assembly in FIG. 20 is rotating in the same clockwise direction as the drive gear for the intake valve system. With an increase of engine speed, however, the partial rotation of the reduction gears assembly for the exhaust cam is opposite in direction to the intake valve assembly. As the exhaust assembly rotates counter-clockwise against the clock-wise rotation of the drive gear, the exhaust valve timing is advanced.

Because it is desirable to open the exhaust valve rapidly to its maximum valve level of lift, the cam lobe engages the contact lever of the camfollower at a point closest to the fulcrum. The cam lobe will then push the contact lever to its maximum rotation before the half-way mark of cam to cam follower contact duration.

FIG. 17, shows the intial action of the intake cam lobe against the contact lever of the cam follower. The lift on the intake valve becomes maximum, or nearly maximum, after the half-way mark of cam contact duration. In FIGS. 21*a* through 21*g*, the exhaust cam lobe is positioned and rotated so that the exhaust valve achieves more than eighty percent (80%) of maximum lift after only thirty degrees (30°) of cam contact rotation. The cam lobe lifts the valve rapidly to a point of maximum lift, passes the half-way mark of cam follower contact at nearly maximum lift, and gradually falls off to closure. This cam lobe action on the cam follower is consistent with the ideal exhaust lift profiles of FIG. 6. FIGS. 22, 23 and 24 show the rotation of the exhaust cam and its suspension bracket assembly following along a limited arc of twenty-four degrees (24°). In a component arrangement that is similar to the intake valve mechanism, the limit lines of sixty-two degrees (62°) and eighty-six (86°) form the horizontal reference lines that define the cam axis rotation about the drive gear.

Figure 22A:
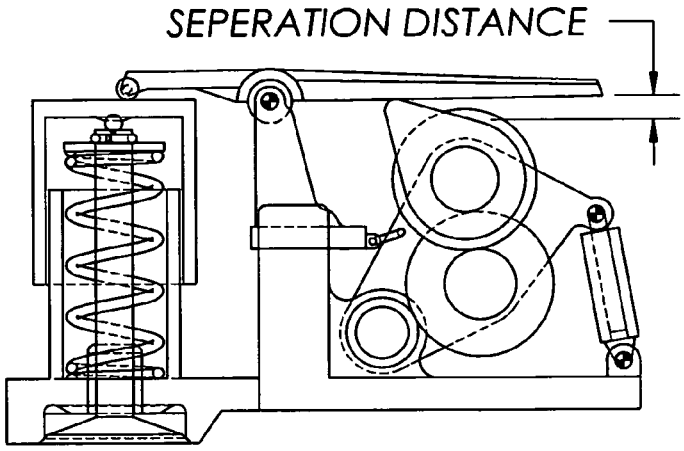
FIGS. 22*a*, 22*b* & 22*c*—Cam heel at idle position with valve rising to maximum level.
Figure 22B:
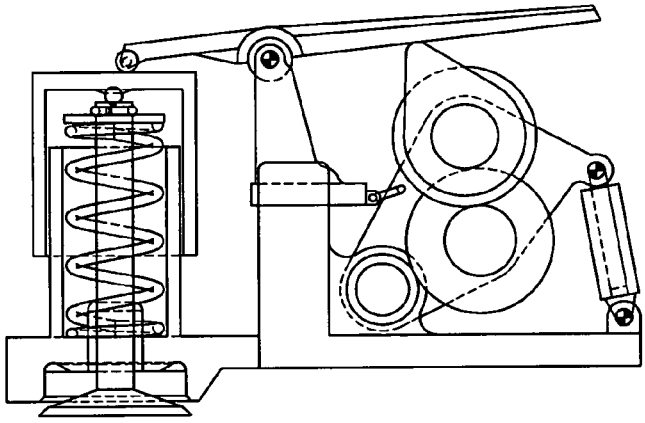
Figure 22C:
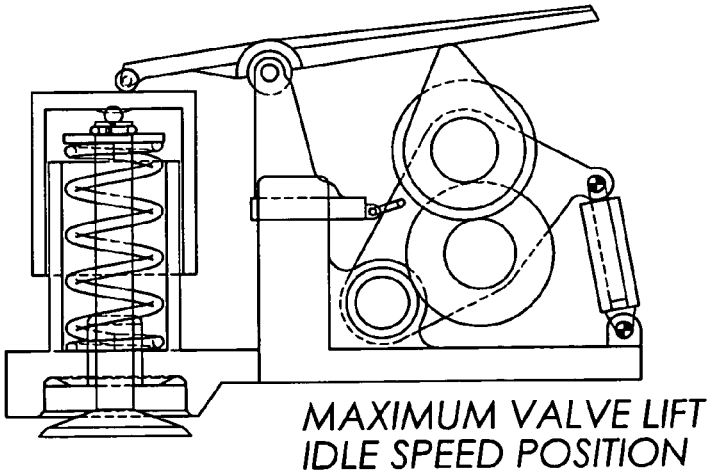
Figure 23A:
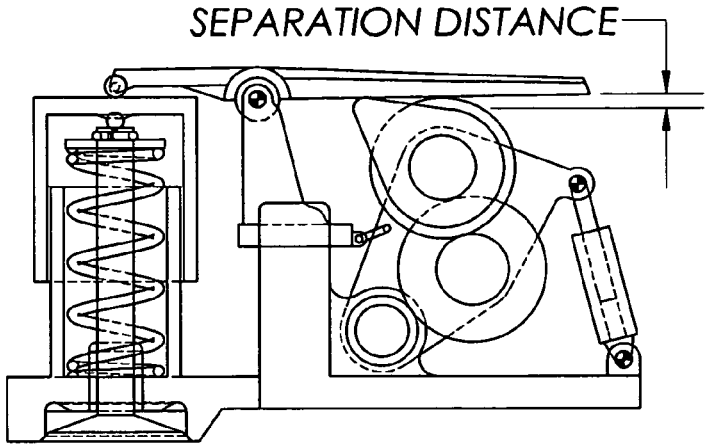
FIGS. 23*a*, 23*b* & 23*c*—Cam heel at cruise position with valve rising to maximum level.
Figure 23B:
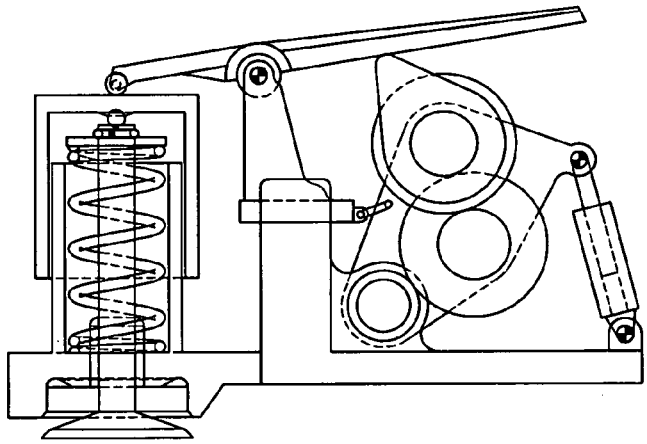
Figure 23C:
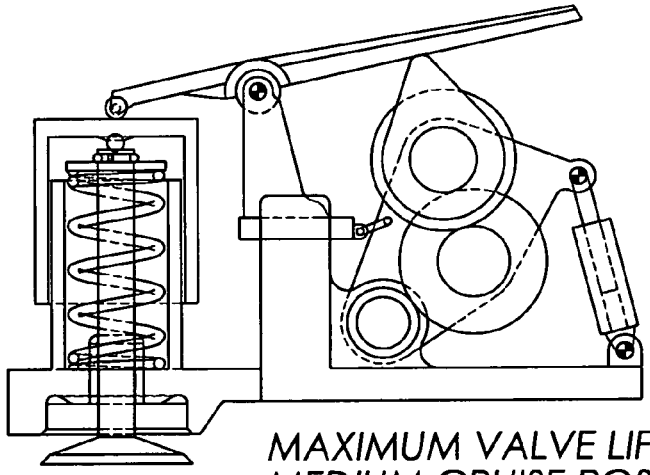

FIGS. 22*a* through 22*c* show a retracted hydraulic piston with the cam and suspension bracket assembly pulled back to the lower limit of rotation. As previously shown with the operation of the intake valve, this "idle speed" position has the greatest amount of separation distance between the cam heel and the cam follower contact lever. In FIGS. 23*a*, 23*b* and 23*c*, the hydraulic piston is partially extended and the cam and reduction assembly has been rotated counter clockwise against the clockwise rotation of the drive gear. As the cam lobe rotates clockwise, the amount of exhaust valve lift increases to a maximum level for this retracted position of the reduction gear assembly. The rotation of the exhaust cam and the reduction gear assembly advances the Mid-Point of the valve opening duration envelope. This is consistent with the desired timing shift in the "pie" diagrams of FIGS. 2*a* through 2*e*. In FIG. 23*c*, the maximum lift for the exhaust valve is shown to be greater than the maximum exhaust valve lift shown in FIG. 22*c*.

Figure 24A:
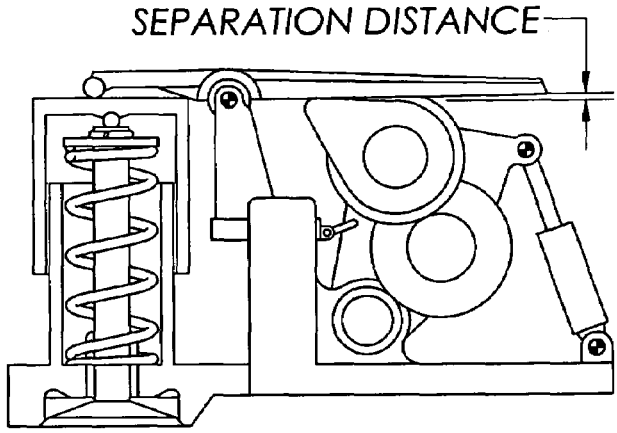
FIGS. 24*a*, 24*b* & 24*c*—Cam heel at high r.p.m. position with valve rising to maximum level.
Figure 24B:
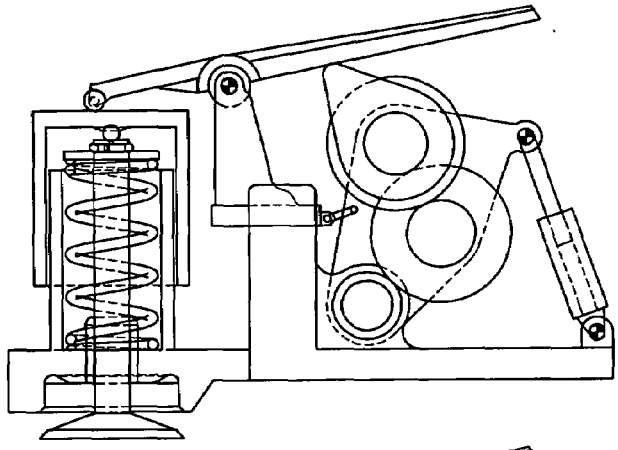
Figure 24C:
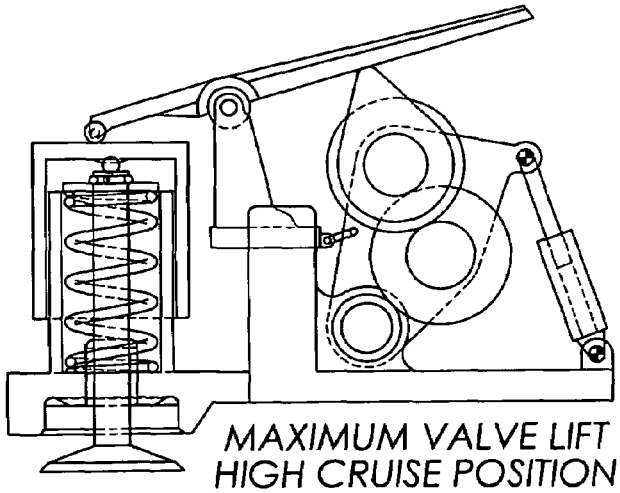

In FIGS. 24*a*, 24*b* and 24*c*, a nearly full extension of the hydraulic piston, and additional rotation of the cam and suspension assembly, has caused further reduction of the separation distance between cam heel and cam follower. The rotation position of initial contact of the cam lobe is advanced and the exhaust valve's opening duration period has also increased. The added rotation of the cam and gear assembly also contributes to the Mid-point timing shift of the duration envelope. In FIG. 24*c*, the exhaust valve maximum lift is graphically shown to be even greater than the amount shown in FIG. 23*c*.

With the tie rod, 14, that links the cam follower tower to the rotating bracket assembly, the amount of fulcrum movement can be set to correspond to the same amount of "x" axis travel by the cam axis. The rocker arm ratio will then remain constant and the level of maximum valve lift can be held within a narrow range.

Enhancements to the Preferred Embodiments

The invention anticipates that alternative designs can be based on the innovation of cam axis movement affecting the valve timing, valve opening duration and valve lift. The design shown in FIGS. 22, 23 and 24 will be hereinafter referred to as the VGC-SF to identify the Sliding Fulcrum feature. The VGC-SF configuration permits the cam heel to remain relatively close to the cam follower fulcrum over the cam's limited arc of rotation. For applications involving high engine r.p.m., the VGC-SF creates a greater asymmetrical rise and fall in the valve lift profile. FIGS. 5*a* through 5*e* show the intake valve reaching maximum lift when the piston is at, or near, bottom dead center of the intake stroke.

An alternative design is presented in the following paragraphs that provides greater economy in mass production by eliminating the complexity of a sliding fulcrum. Instead, the design relies on an intermeshed cam follower and rocker arm that pivot on their own dedicated mounting stands. Moreover, less space or "real estate" on top of the cylinder head is required. This design will be identified as the VGC-ICR; "Intermeshed Cam follower and Rocker arm". The design compromise of the VGC-ICR is the loss of cam operation in close proximity to the cam follower fulcrum. The lift profiles of the VGC-ICR are not as asymmetrically pronounced as those developed by the VGC-SF. For low r.p.m. engines, the VGC-ICR design economy may be worth the sacrifice of optimum lift profiles.

The VGC-ICR Design

Figure 25A:
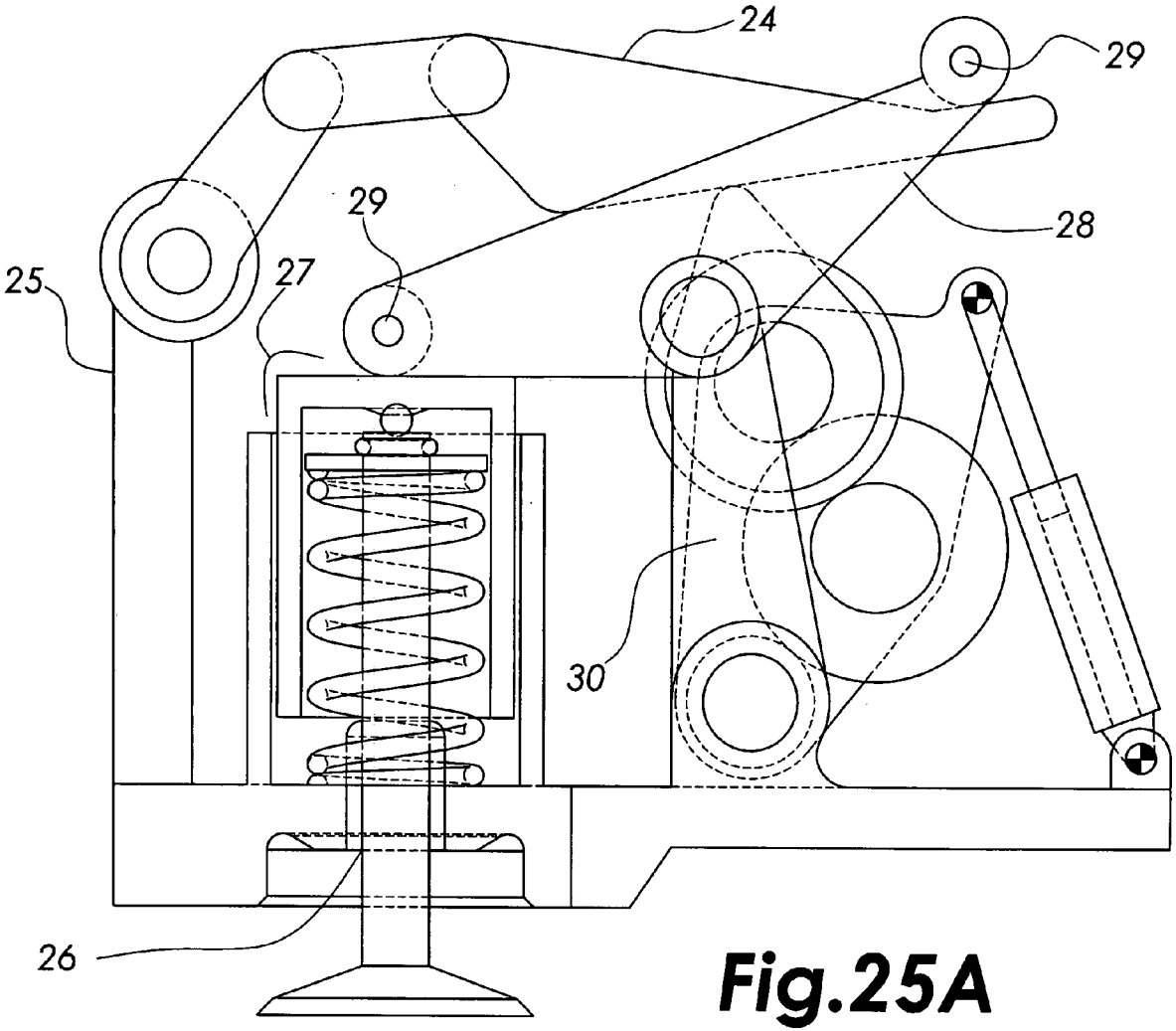
FIG. 25—Partial Assembly of Alternative Design; VGC-ICR, Intermeshed Cam follower and Rocker arm.
Figures 26A, 26B:
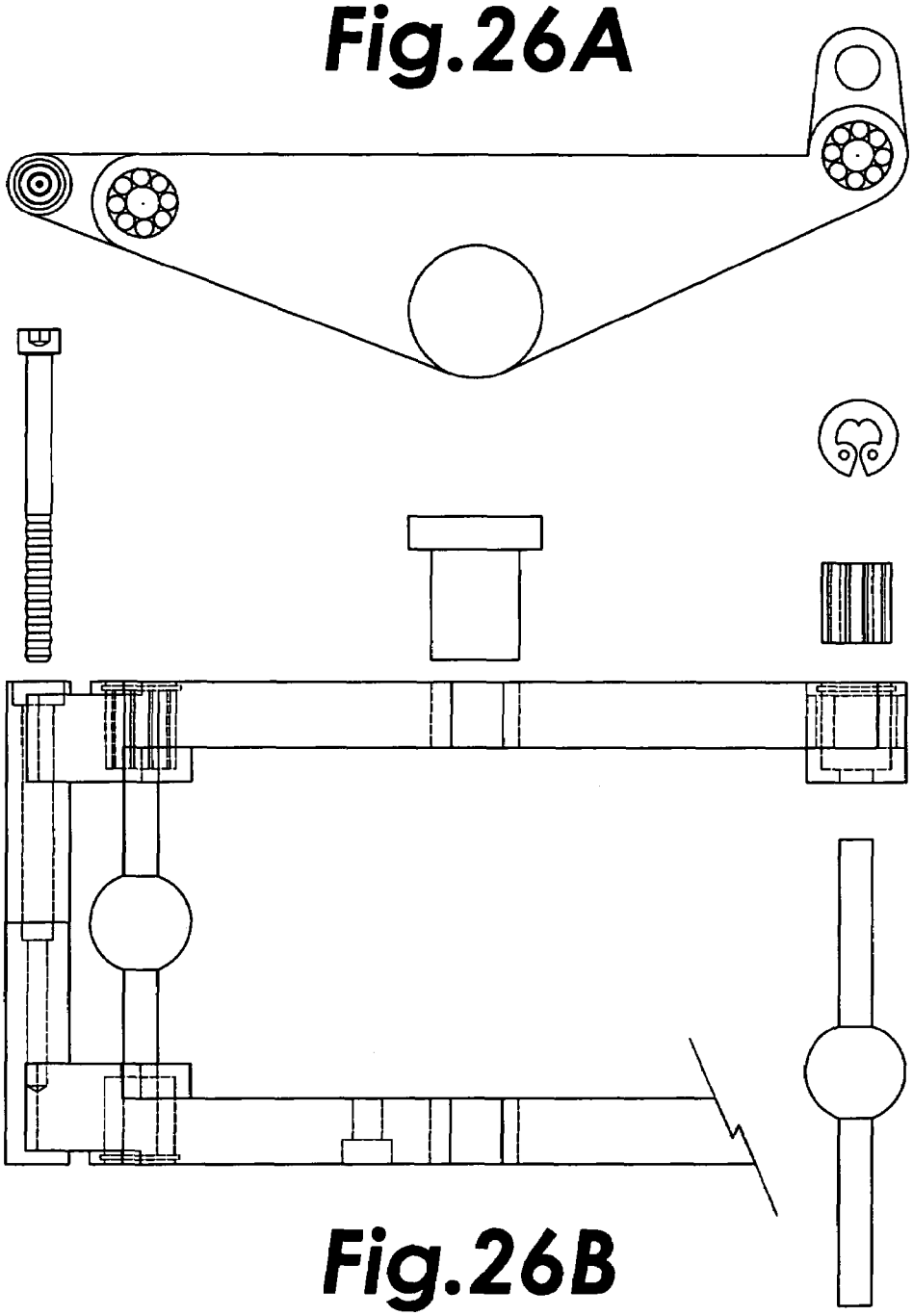
FIGS. 26*a* & 26*b*—Side & Top view; Rocker Arm Frame
Figure 27A:
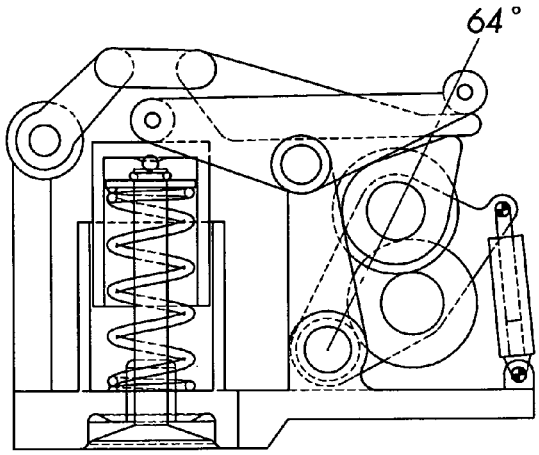
FIGS. 27*a,b,c* & *d*.—Cam axis, sixty-two degrees (62°) from horizontal, Fig. a,b,c & d show a sequential rotation of the cam to maximum lift.
Figure 27B:
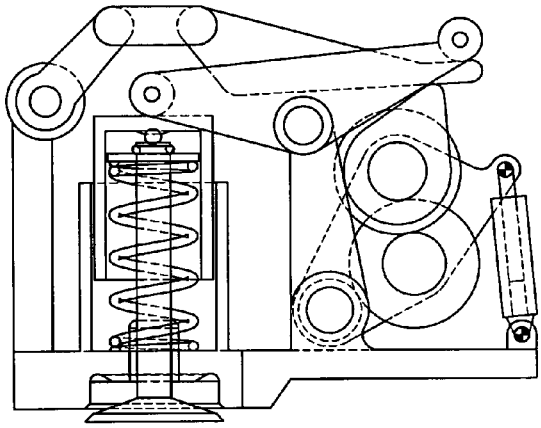
Figure 27C:
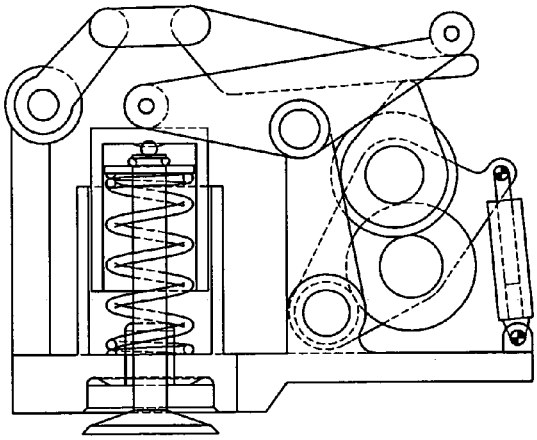
Figure 27D:
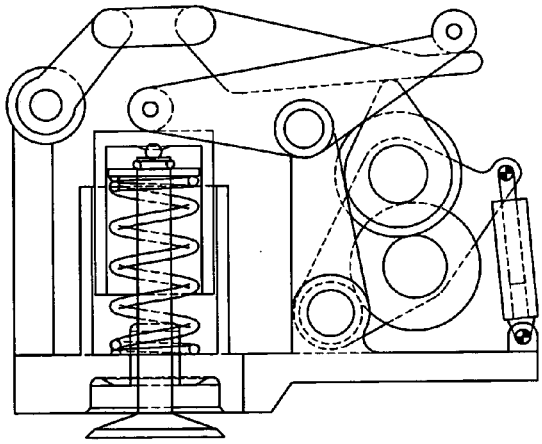
Figure 28A:
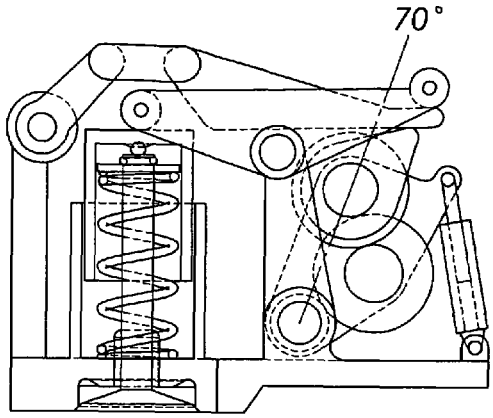
FIGS. 28*a,b,c* & *d*.—Cam axis, seventy degrees (70°) from horizontal, Fig. a,b,c & d show a sequential rotation of the cam to maximum lift.
Figure 28B:
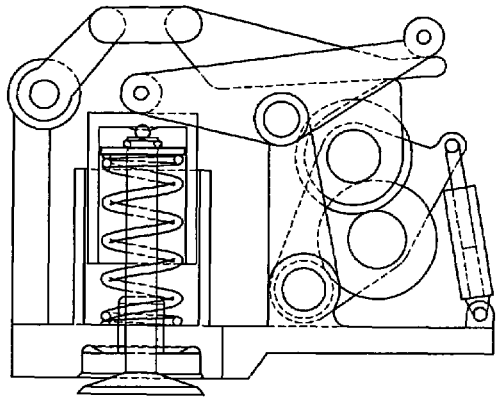
Figure 28C:
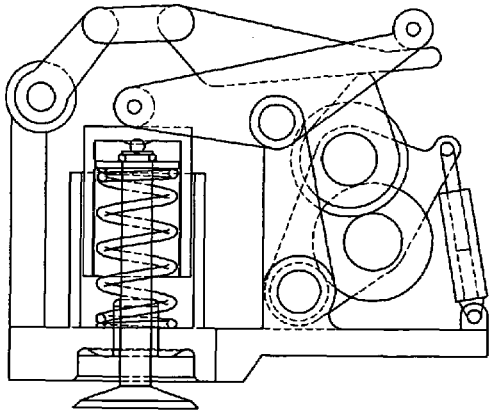
Figure 28D:
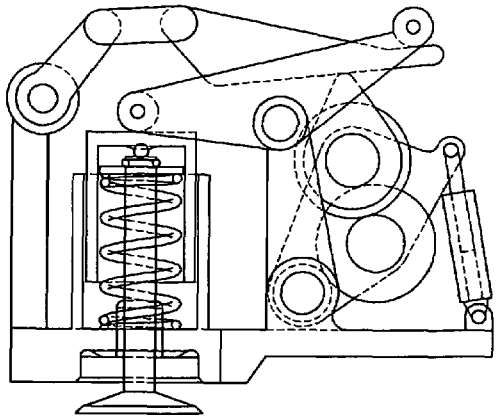
Figure 29A:
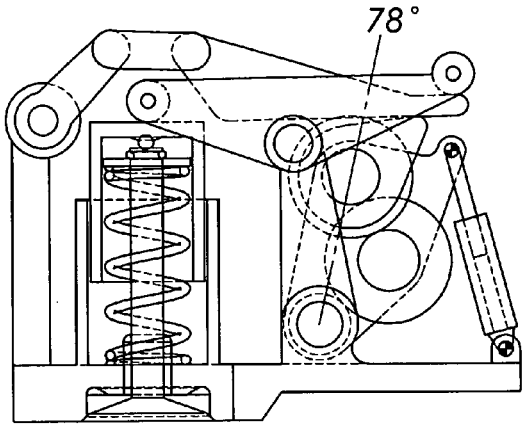
FIGS. 29*a,b,c* & *d*.—Cam axis, seventy eight degrees (78°) from horizontal, Fig.a,b,c&d show a sequential rotation of the cam to maximum lift.
Figure 29B:
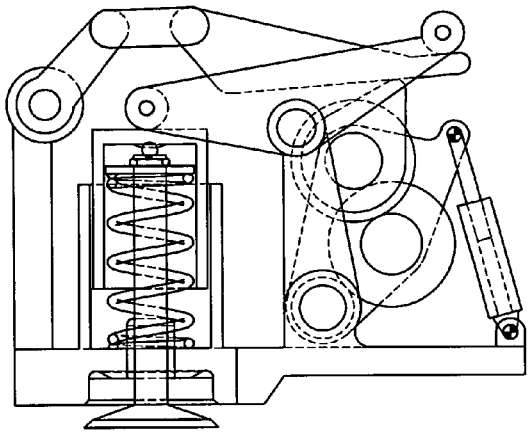
Figure 29C:
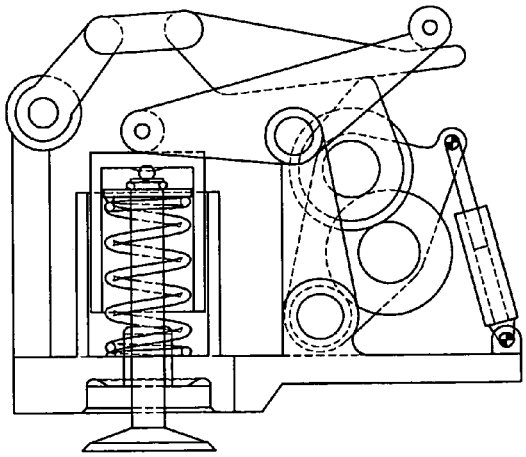
Figure 29D:
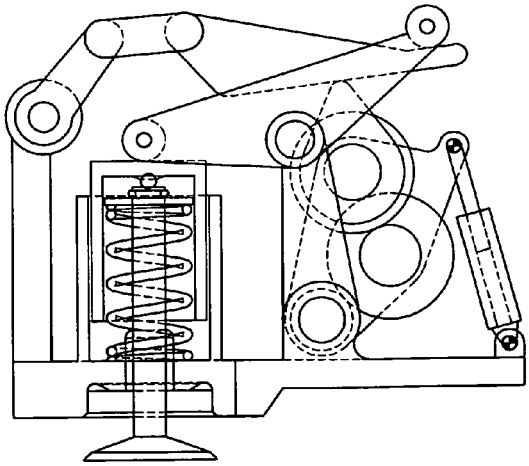
Figure 30A:
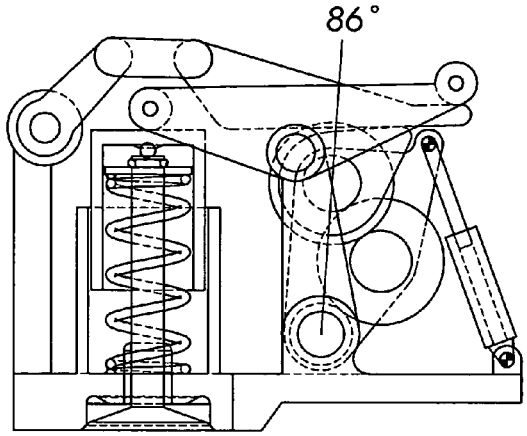
FIGS. 30*a,b,c* & *d*. Cam axis, eighty six degrees (86°) from horizontal, Fig. a,b,c & d show a sequential rotation of the cam to maximum lift.
Figure 30B:
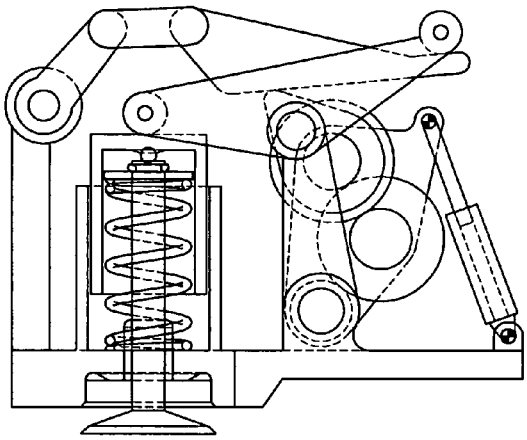
Figure 30C:
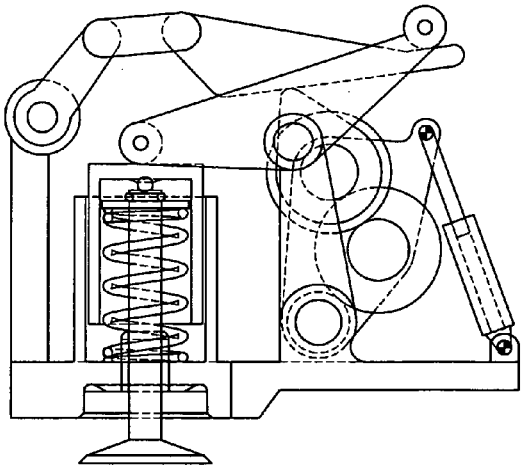
Figure 30D:
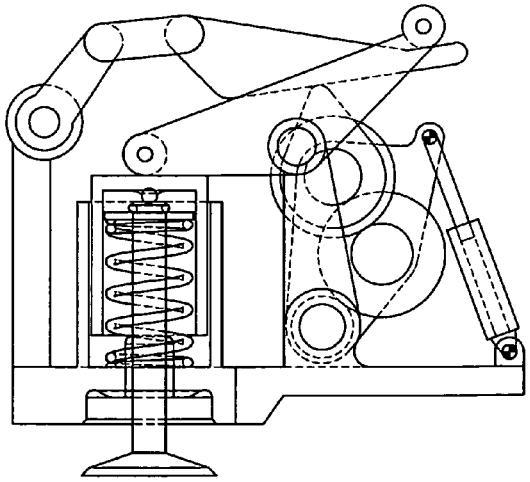

FIG. 25 shows a partial assembly of the ICR design components. The cam follower, 24, pivots on a mounting stand, 25, that is adjacent to the valve cylinder, 26. The structural recess of the cam follower extends over the top surface of the valve piston, 27. A rocker arm frame, 28, that holds two (2) roller axles, 29, is shown in FIGS. 26*a* and 26*b*. FIG. 25 shows one (1) of the two (2) rocker arm mounting stands, 30, that supports the rocker arm frame.

FIGS. 27 through 30 show the VGC-ICR design in four (4) distinct positions of the cam and gear reduction assembly, 31, along the same twenty-four degree (24°) arc of rotation as the VGC-SF design. FIGS. 27*a*, through 27*d* show the cam rotation producing a minimum amount of valve lift that is compatible with low speed operation. FIGS. 28*a* through 28*d* and 29*a* through 29*d*, show the movement of the cam and gear reduction assembly along its limited arc of rotation. The rotation produces additional valve lift and a greater valve opening duration. FIGS. 3 through 30*a* shows the cam and gear reduction assembly at the upper limit of arc rotation. The rotation of the cam produces the maximum amount of valve lift and the longest period of valve opening duration.

Limited Rotation of the Cam Axis with the Gear Reduction Assembly

Figure 7A:
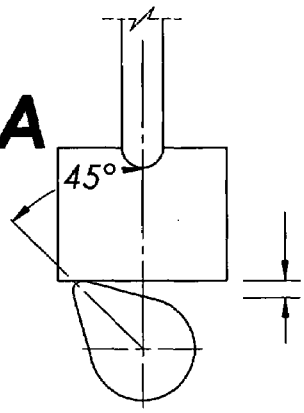
FIGS. 7*a* through 7*f*—Cam interaction with solid lifter.
Figure 7B:
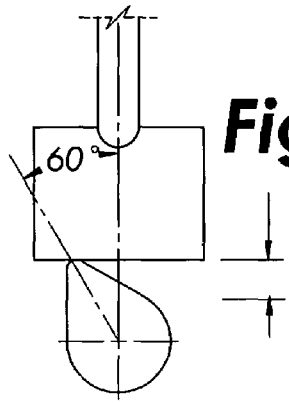
Figure 7C:
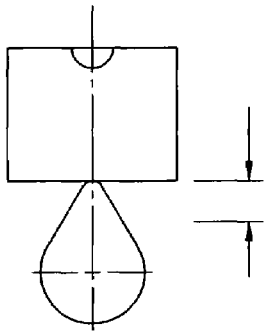
Figure 7D:
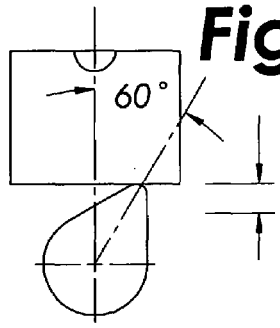
Figure 7E:
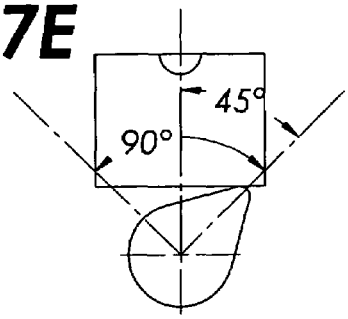
Figure 7F:
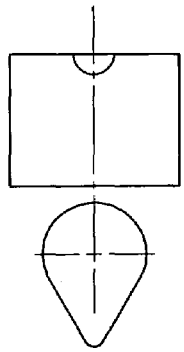
Figure 8A:
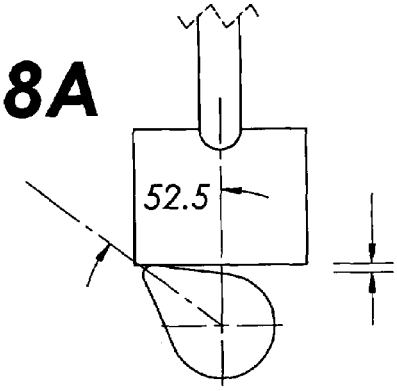
FIGS. 8*a* through 8*f*—Cam interaction with solid lifter.
Figure 8B:
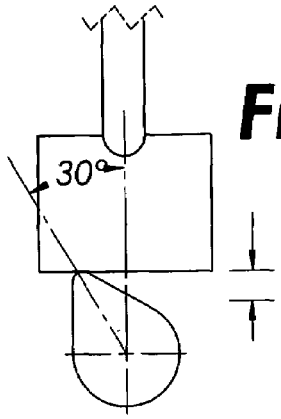
Figure 8C:
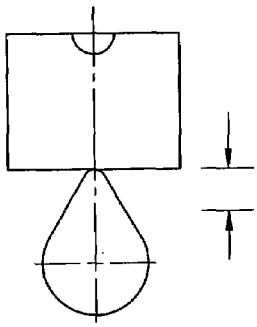
Figure 8D:
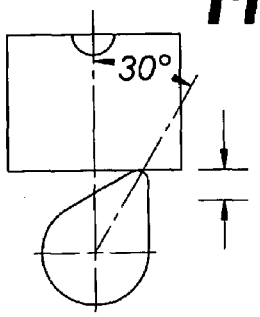
Figure 8E:
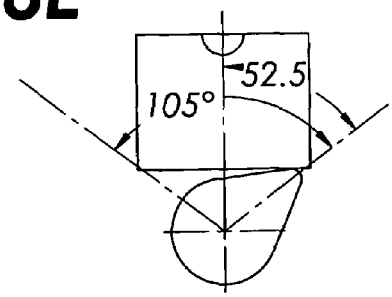
Figure 8F:
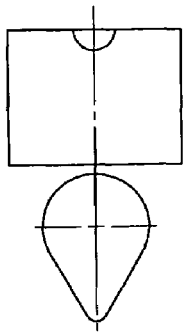
Figure 9A:
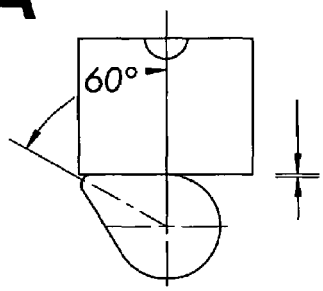
FIGS. 9*a* through 9*f*—Cam interaction with solid lifter.
Figure 9B:
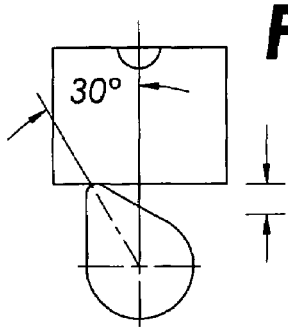
Figure 9C:
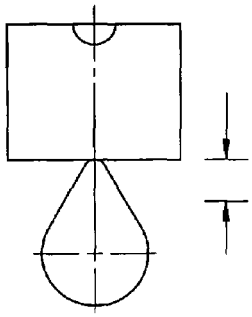
Figure 9D:
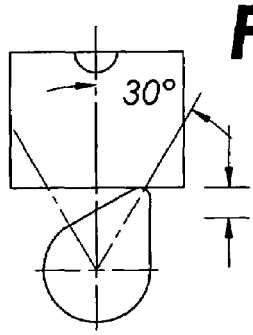
Figure 9E:
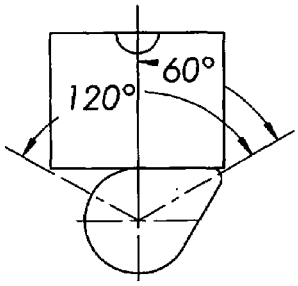
Figure 9F:
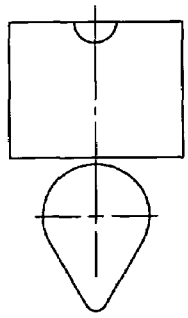
Figure 10:
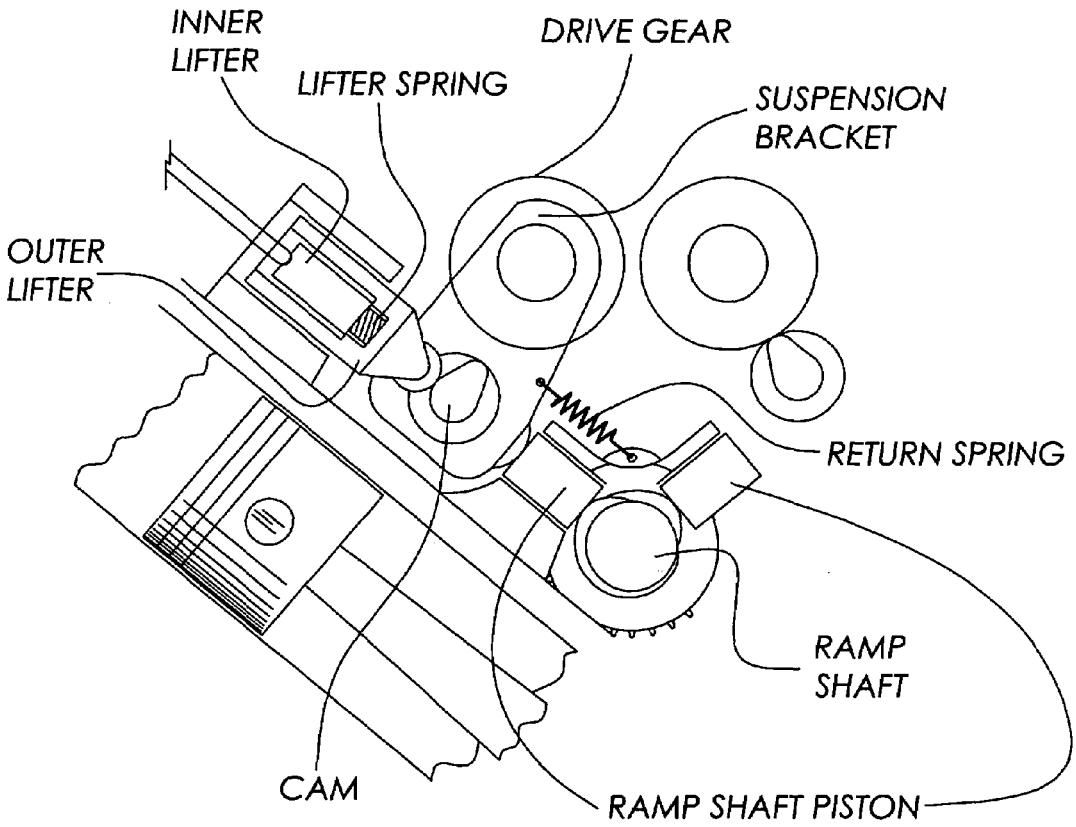
FIG. 10—Suspension assembly supported cam with valve train, reprint of U.S. Pat. No. 6,189,497, Griffiths FIG. 11—Side view of gear reduction, cam cam follower on sliding base, and hydraulic actuator.

FIGS. 10 and 11 of U.S. Pat. No. 6,189,497, Griffiths, show a method of transferring the force created by centrifugal weights on the flywheel to rotate the cam and suspension bracket assembly. FIG. 11 of the patent shows the motion of a rotor, 45, along the drive shaft axis. This design can be used to drive a hydraulic master cylinder to activate the slave cylinder, 8, as shown in FIGS. 17, 22, 23 and 24. The invention also anticipates that two (2) centrifugal weighted flywheels can be arranged face to face. With increasing engine speed each of the flywheel rotors will move toward each other. Hydraulic master cylinders can be inserted between the converging rotors to receive equal pressure from both directions. This arrangement will cancel the thrust forces on the crankshaft that would otherwise be applied to crankshaft bearings.

The invention also anticipates that solenoids, stepper motors or other electrical actuators can be used to rotate the cam and gear reduction assembly. The use of electrical components, as the primary force to move the cam and gear reduction assembly will, however, compromise the inherent reliability of the system.

Electrical actuators are better employed as non-critical components that respond to feedback directives from an engine management system to further improve operational economy. The sensed changes to engine load, engine speed, and air density can trigger adjustments to a lever ratio or cause a timing shift in cam lobe contact. The failure of a sensor, actuator or circuit will not significantly impair the variable operation of the valve system or compromise the continued operation of the engine.

TABLE 1

| | | | |
|---|---|---|---|
| Lower Limit | | | |
| | alpha | Sixty-Two degrees (62°), | sine 62° = .8829 |
| | beta | Sixty-Six degrees (66°), | sine 64° = .9135 |
| | gamma | Seventy degrees (70°), | sine 70° = .9397 |
| | delta | Seventy-Four degrees (74°), | sine 74° = .9613 |
| | epsilon | Seventy-Eight degrees (78°), | sine 78° = .9781 |
| | zeta | Eighty-Two degrees (82°), | sine 82° = .9903 |
| | eta | Eighty-Six degrees (86°), | sine 86° = .9976 |
| Upper Limit | | | |

TABLE 2

| Cam Heel Position | Position in x° From Horizontal | Angle of Cam/Lever Contact | Cam Contact Duration | Crankshaft Rotation Duration | Lobe Lift ($xR_2$) |
|---|---|---|---|---|---|
| alpha | 62° | 45.0° | 90.0° | 180.0° | 2.34 |
| beta | 66° | 40.7° | 98.6° | 197.3° | 2.79 |
| gamma | 70° | 37.2° | 105.6° | 211.2° | 3.18 |
| delta | 74° | 34.4° | 111.2° | 222.4° | 3.47 |
| epsilon | 78° | 32.3° | 115.3° | 230.6° | 3.71 |
| zeta | 82° | 31.2° | 117.6° | 235.2° | 3.86 |
| eta | 86° | 30.0° | 120.0° | 240.0° | 4.00 |

LIST OF PARTS AND COMPONENTS

Variable Geometry Camshaft Sliding Fulcrum, VGC-SF

1. Camshaft
2. Suspension Bracket
3. Drive Gear
4. Outer Idler Gear
5. Inner Idler Gear
6. Cam Gear
7. Drive Gear Shaft
8. Hydraulic Piston
9. Cam Follower Contact Lever
10. Cam Follower Tower
11. Cam Follower Fulcrum
12. Guide Track
13. Rocker Arm Lever
14. Tie Rod
15. Rocker Arm Roller
16. Valve Bearing 17. Valve Piston
18. Valve Cylinder
19. Valve Spring
20. Valve
21. Valve Plate
22. Valve Guide
23. Valve Seat Variable Geometry Camshaft Intermeshed Camfollower & Rocker Arm, VGC-ICR 24. Cam Follower
25. Cam Follower Mounting Stand
26. Valve Cylinder
27. Valve Piston
28. Rocker Arm Frame
29. Roller Axle
30. Roller Axle Supports
31. Rocker Arm Mounting Stand
32. Cam & Gear Reduction Assembly

The invention claimed is:

1. An apparatus for improving variable valve timing and lift of an internal combustion engine comprising:

a camshaft including a cam, a cam gear, and a camshaft axis, wherein rotation of said cam gear rotates said camshaft and said cam;

a cam follower operatively coupled to a valve, wherein rotation of said cam raises and lowers said cam follower, wherein said raising and lowering of said cam follower opens and closes said valve;

a drive shaft including a drive gear and a drive shaft axis, wherein rotation of said drive shaft rotates said drive gear;

an idler gear including a outer idler gear and an inner idler gear, wherein said drive gear is operatively coupled to said idler gear, wherein rotation of said drive gear rotates said inner idler gear and said outer idler gear, wherein said outer idler gear is operatively coupled to said cam gear, wherein rotation of said outer idler gear rotates said cam gear;

a suspension bracket assembly including a pivot, wherein said camshaft, said drive shaft, and said idler gear are operatively coupled to said suspension bracket assembly, wherein said suspension bracket assembly pivots around said pivot; and a driving member, wherein said driving member is operatively coupled to said suspension bracket assembly, wherein movement of said driving member pivots said suspension bracket assembly, wherein said pivoting of said suspension bracket assembly rotates the spatial location of said camshaft axis around said drive shaft axis.

2. The apparatus of claim 1, wherein the rotation of said camshaft axis is through an arc.

3. The apparatus of claim 1, wherein said driving member is a hydraulic piston.

4. The apparatus of claim 1, further comprising:

a guide tower including a guide tower pivot and a base, wherein said cam follower pivots around said pivot of said guide tower to lift and depress said valve train;

a guide track operatively coupled to said base of said guide tower, wherein said guide track enables horizontal movement of said guide tower; and a tie rod coupled to said suspension bracket assembly and said guide track at a first tie rod pivot and a second tie rod pivot, wherein said tie rod pivots about said first tie rod pivot and said second tie rod pivot in response to rotation of said suspension bracket assembly, wherein said pivoting of said tie rod moves said guide track, wherein movement of said guide track alters the position of said guide tower pivot, wherein said cam follower alters valve lift in response to the change in position of said guide tower.

5. The apparatus of claim 4, wherein said driving member is a hydraulic piston.

* * * * *